US009162489B2

(12) United States Patent
Kawai

(10) Patent No.: US 9,162,489 B2
(45) Date of Patent: Oct. 20, 2015

(54) PRINTED MATTER PRODUCING APPARATUS

(71) Applicant: Brother Kogyo Kabushiki Kaisha, Nagoya-shi, Aichi-ken (JP)

(72) Inventor: Junya Kawai, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/636,968

(22) Filed: Mar. 3, 2015

(65) Prior Publication Data

US 2015/0251455 A1 Sep. 10, 2015

(30) Foreign Application Priority Data

Mar. 4, 2014 (JP) ..... 2014-042201

(51) Int. Cl.
*B41J 2/325* (2006.01)
*B41J 3/407* (2006.01)
*B41J 11/00* (2006.01)

(52) U.S. Cl.
CPC ..... *B41J 11/007* (2013.01); *B41J 3/4076* (2013.01)

(58) Field of Classification Search
USPC ..... 347/16, 19, 101, 104, 215
See application file for complete search history.

(56) References Cited

U.S. PATENT DOCUMENTS 5,069,556 A * 12/1991 Sasaki et al. ..... 347/19
5,798,773 A * 8/1998 Hiramatsu et al. ..... 347/19
6,700,593 B2 * 3/2004 Otsuki ..... 346/19

FOREIGN PATENT DOCUMENTS

JP H08-207371 A 8/1996
JP 3093958 U 5/2003
JP 2005-007671 A 1/2005

* cited by examiner

*Primary Examiner* — Kristal Feggins
(74) *Attorney, Agent, or Firm* — Banner & Witcoff, Ltd.

(57) ABSTRACT

This is disclosed a printer comprising a visual confirmation window, a first coordination control portion, and a second coordination control portion. The visual confirmation window is for visually confirming a recording medium with print taken up by a take-up body from an exterior of a housing. The first coordination control portion controls a feeding motor, a take-up motor, and heating elements in coordination so as to form a predetermined test pattern on the recording medium prior to the start of production of a printed matter. The second coordination control portion controls the feeding motor and the take-up motor in coordination so that, after formation of the test pattern, the test pattern formed on the recording medium arrives and stops near the visual confirmation window.

11 Claims, 19 Drawing Sheets

COMPARISON EXAMPLE

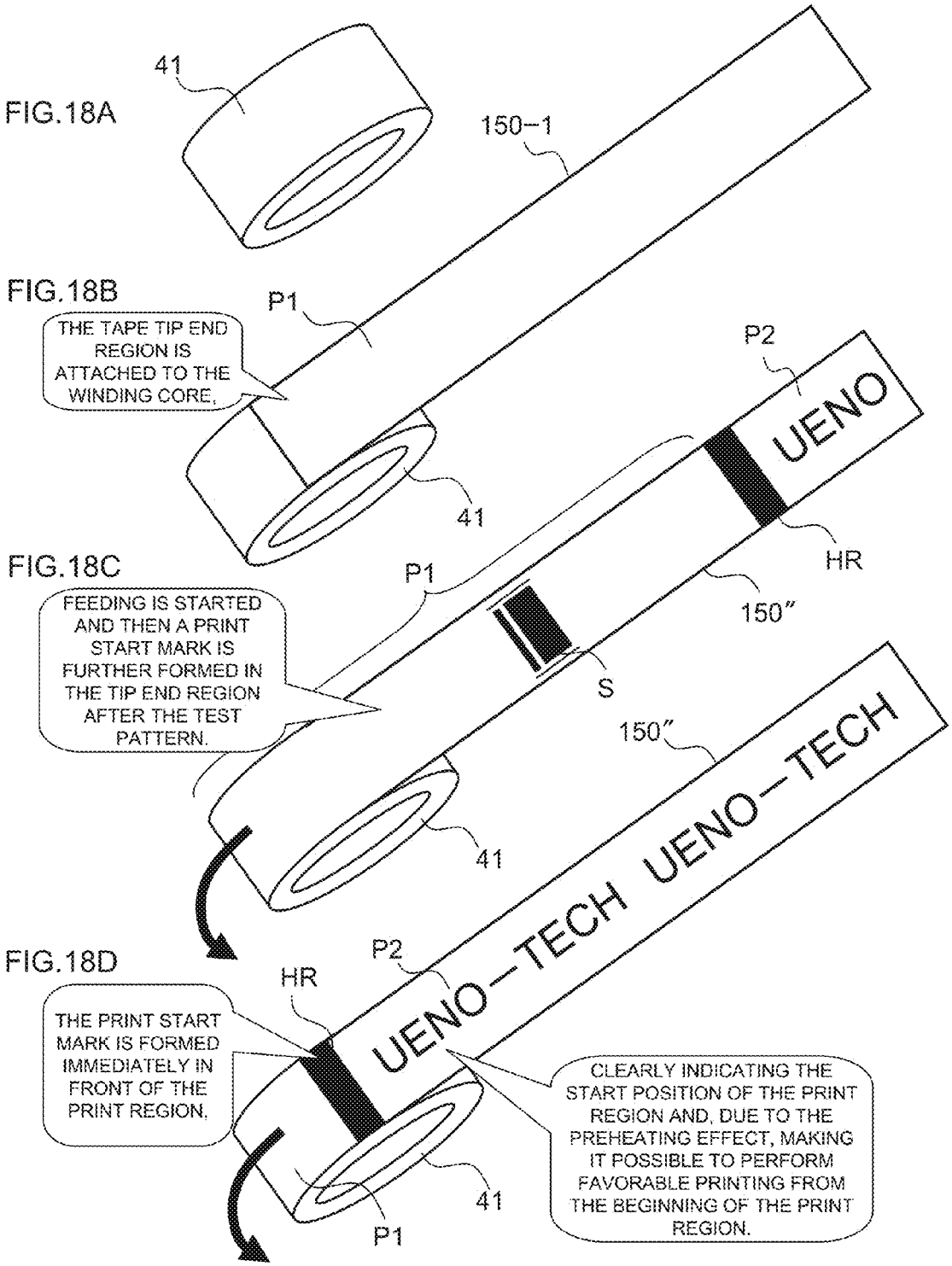
FIG.18A
41
150−1
FIG.18B
P1
THE TAPE TIP END REGION IS ATTACHED TO THE WINDING CORE.
P2
UENO
41
HR
FIG.18C
P1
FEEDING IS STARTED AND THEN A PRINT START MARK IS FURTHER FORMED IN THE TIP END REGION AFTER THE TEST PATTERN.
150″
S
150″
UENO−TECH UENO−TECH
41
FIG.18D
HR
P2
THE PRINT START MARK IS FORMED IMMEDIATELY IN FRONT OF THE PRINT REGION.
CLEARLY INDICATING THE START POSITION OF THE PRINT REGION AND, DUE TO THE PREHEATING EFFECT, MAKING IT POSSIBLE TO PERFORM FAVORABLE PRINTING FROM THE BEGINNING OF THE PRINT REGION.
41
P1

PRINTED MATTER PRODUCING APPARATUS

CROSS-REFERENCE TO RELATED APPLICATION

The present application claims priority from Japanese Patent Application No. 2014-042201, which was filed on Mar. 4, 2014, the disclosure of which is incorporated herein by reference in its entirety.

BACKGROUND

1. Field

The present disclosure relates to a printed matter producing apparatus that produces printed matter.

2. Description of the Related Art

There are known printed matter producing apparatuses (printers) that form desired print while feeding adhesive tape with paste applied to its back surface. According to this prior art, an adhesive tape on which print has been formed (a tape with wash resistant characters) is sequentially taken up around a core material, thereby producing a roll-shaped printed matter.

If print formation is performed as described above, faint print or the like may occur due to attached matter, such as dust, on the printing head or nearby area, causing a decrease in print quality. If printed matter is thus produced by take-up of the adhesive tape with print and the faint print or the like is found after production of the printed matter, the problem arises that the printed matter generated by take-up becomes a defective product, resulting in waste.

SUMMARY

It is therefore an object of the present disclosure to provide a printed matter producing apparatus capable of suppressing the waste that results from the occurrence of defective products after printed matter generation.

In order to achieve the above-described object, according to one aspect of the present application, there is provided a printer comprising a feeder configured to feed a recording medium, a feeding motor configured to drive the feeder, a printing head configured to form desired print by heating elements on the recording medium fed by the feeder and form a recording medium with print, a take-up body configured to sequentially take up the recording medium with print on an outer circumference and produce a roll-shaped printed matter, a take-up motor configured to drive the take-up body, a housing comprising the feeder, the feeding motor, the printing head, the take-up body, and the take-up motor in its interior, a visual confirmation window that is provided on the housing and is for visually confirming the recording medium with print taken up by the take-up body disposed in an interior of the housing from an exterior of the housing, a first coordination control portion configured to control the feeding motor, the take-up motor, and the heating elements in coordination so as to form a predetermined test pattern on the recording medium prior to the start of production of the printed matter, and a second coordination control portion configured to control the feeding motor and the take-up motor in coordination so that, after formation of the test pattern on the recording medium by the control of the first coordination control portion, the test pattern formed on the recording medium arrives and stops near the visual confirmation window.

In the printed matter producing apparatus in the present disclosure, a recording medium is fed by a feeder driven by a feeding motor, and desired print is formed on the fed recording medium by the printing head. The recording medium with print on which print has been formed is sequentially taken up around a predetermined axis by a take-up body driven by a take-up motor, producing roll-shaped printed matter.

Hence, in general, if print formation is performed by the printing head, faint print or the like may occur due to attached matter, such as dust, on the printing head or nearby area, causing a decrease in print quality. If printed matter is thus produced by take-up of the recording medium with print and the faint print or the like is found after production of the printed matter, the printed matter generated by take-up becomes an entirely defective product, resulting in waste.

Hence, according to the present disclosure, a first coordination control portion controls the feeding motor, take-up motor, and heating elements in coordination, forming a predetermined test pattern into print on the recording medium with the feeder, take-up body, and printing head working in cooperation.

At this time, in the present disclosure, a visual confirmation window for visually confirming the recording medium with print to be taken up by the take-up body is provided in the housing. Then, a second coordination control portion controls the feeding motor and take-up motor in coordination, causing the feeder and take-up body to work in cooperation and the test pattern formed into print as described above to arrive and stop near the visual confirmation window. With this arrangement, the user can visually confirm the test pattern formed on the recording medium via the visual confirmation window. Accordingly, the user can visually confirm whether or not the print quality has decreased due to the occurrence of faint print or the like such as described above, before production of the printed matter is actually started. As a result, it is possible to suppress the wasteful occurrence of defective products such as described above, making it possible to improve convenience.

BRIEF DESCRIPTION OF THE DRAWINGS

FIG. 18A is an explanatory view showing the behavior of attaching a tip end region of the tape to the winding core and performing printing in a modification in which a print start mark is formed.

FIG. 18B is an explanatory view showing the behavior of attaching a tip end region of the tape to the winding core and performing printing in the modification in which a print start mark is formed.

FIG. 18C is an explanatory view showing the behavior of attaching a tip end region of the tape to the winding core and performing printing in the modification in which a print start mark is formed.

FIG. 18D is an explanatory view showing the behavior of attaching a tip end region of the tape to the winding core and performing printing in the modification in which a print start mark is formed.

DETAILED DESCRIPTION OF THE PREFERRED EMBODIMENTS

Figure 1:
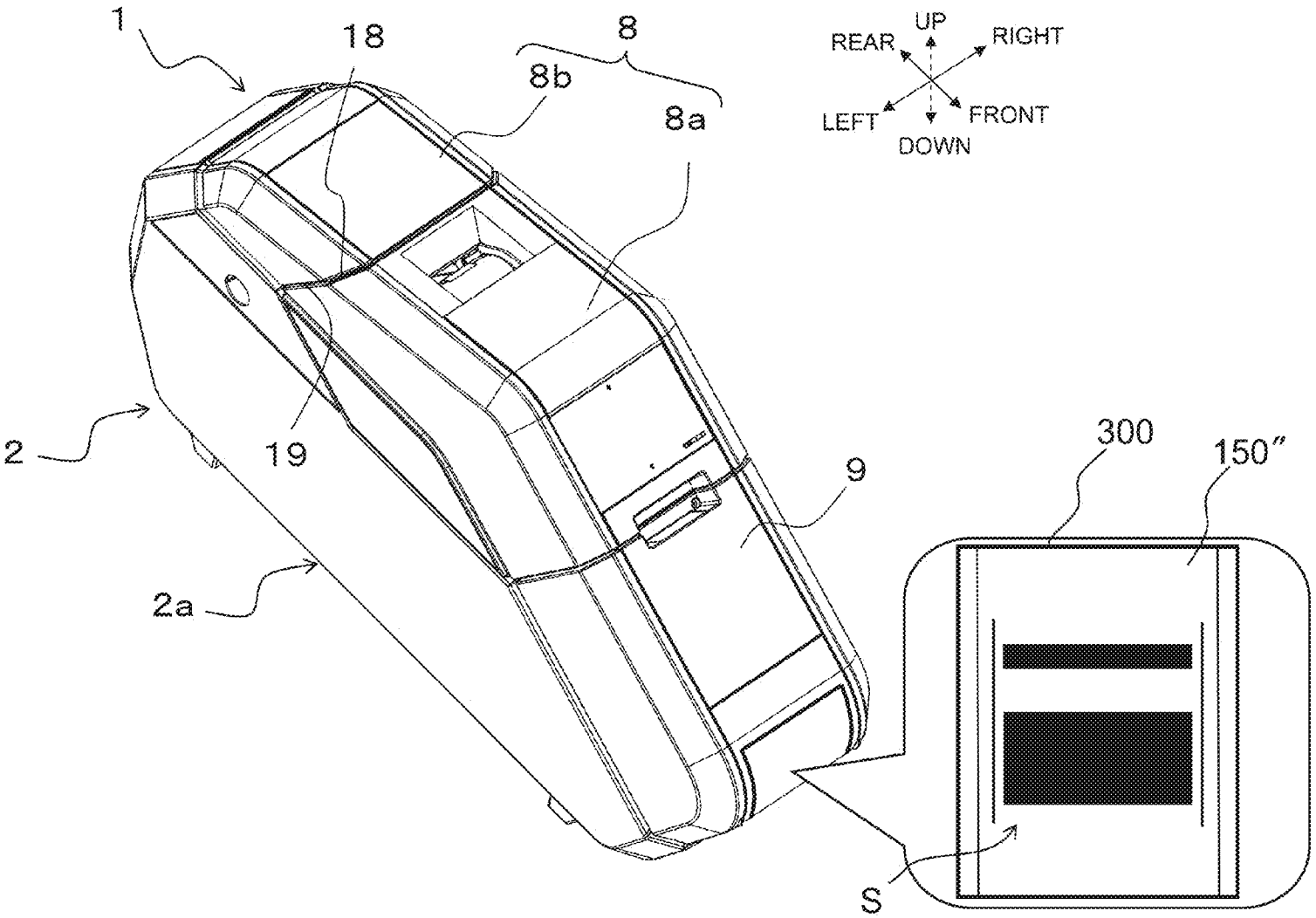
FIG. 1 is a perspective view showing the outer appearance of the tape printer related to an embodiment of the present disclosure.

The following describes an embodiment of the present disclosure with reference to accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the tape printer related to this embodiment will be described with reference to FIGS. 1-4.

Housing

In FIGS. 1-4, a tape printer 1 in this embodiment comprises a housing 2 that constitutes the apparatus outer contour. The housing 2 comprises a housing main body 2*a*, a rearward-side opening/closing part 8, and a frontward-side opening/closing cover 9.

The housing main body 2*a* comprises a first storage part 3 disposed on the rearward side, and a second storage part 5 and a third storage part 4 disposed on the frontward side.

The rearward-side opening/closing part 8 is connected to an upper area of the rearward side of the housing main body 2*a* in an openable and closeable manner. This rearward-side opening/closing part 8 is capable of opening and closing the area above the first storage part 3 by pivoting. The rearward-side opening/closing part 8 includes a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. Specifically, the first opening/closing cover 8*a* is capable of pivoting from a closed position (the states in FIGS. 1 and 2) in which it covers the area above the frontward side of the first storage part 3, to an open position (the states in FIGS. 3 and 4) in which it exposes that area.

Figure 2:
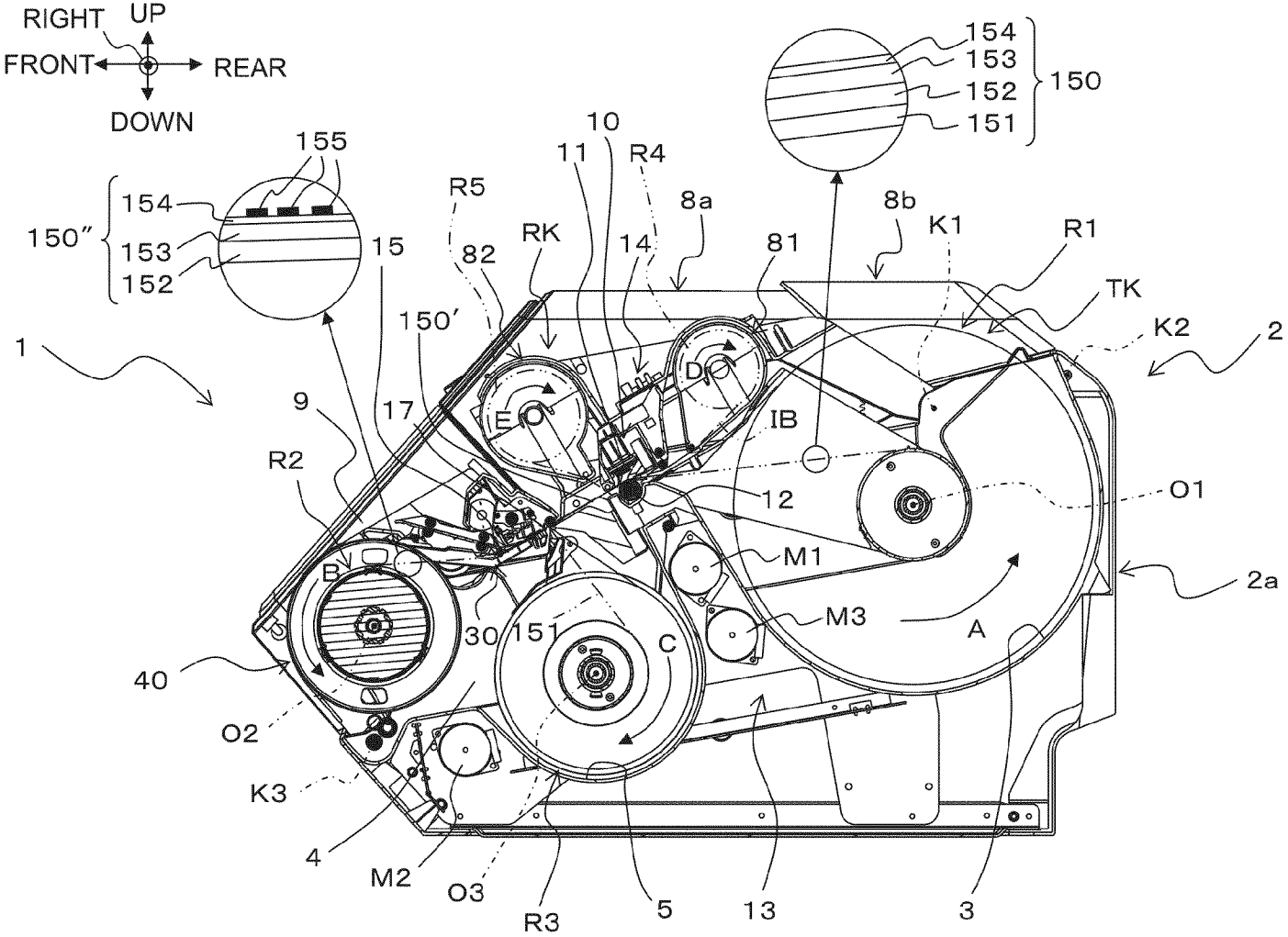
FIG. 2 is a side cross-sectional view showing the internal structure of the tape printer.
Figure 3:
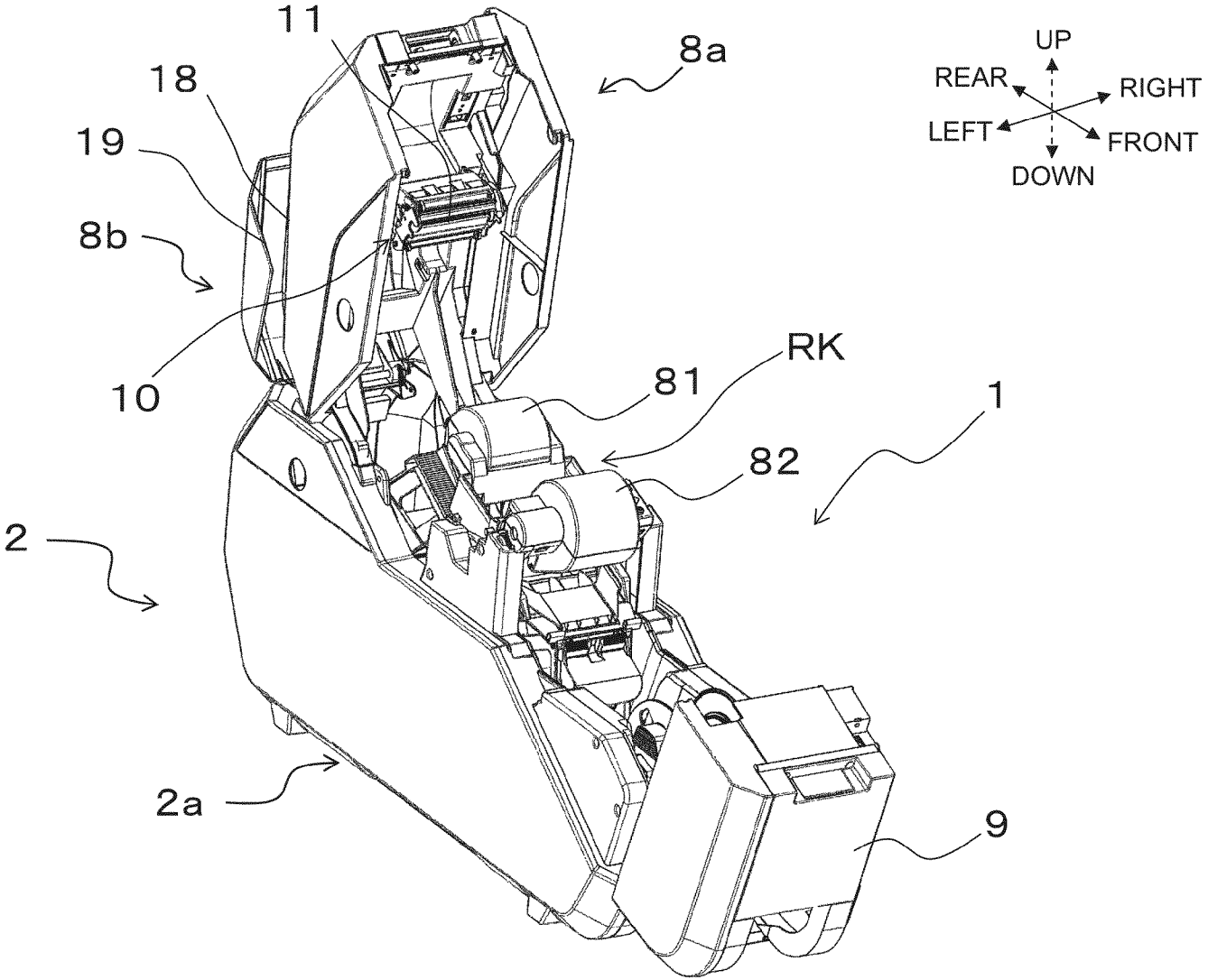
FIG. 3 is a perspective view showing the outer appearance of the tape printer with the first, second, and frontward-side opening/closing covers open.

A head holding body 10 is disposed in the interior of the first opening/closing cover 8*a* (refer to FIG. 3 as well). Then, the first opening/closing cover 8*a* pivots around the above described pivot axis K1, making it possible to move a printing head 11 included in the head holding body 10 relatively closer to or farther away from a feeding roller 12 disposed in the housing main body 2*a*. That is, the printing head 11 moves close to the feeding roller 12 in the above described closed position (the states in FIGS. 1 and 2) of the first opening/closing cover 8*a*, and moves away from the feeding roller 12 in the above described open position (the states in FIGS. 3 and 4) of the first opening/closing cover 8*a*.

The second opening/closing cover 8*b* is disposed further on the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*. Specifically, the second opening/closing cover 8*b* is capable of pivoting from a closed position (the states in FIGS. 1 and 2) in which it covers the area above the rearward side of the first storage part 3, to an open position (the states in FIGS. 3 and 4) in which it exposes that area.

Then, the first opening/closing cover 8*a* and the second opening/closing cover 8*b* are configured so that, when each is closed, an outer circumference part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the third storage part 4 by pivoting around a predetermined pivot axis K3 disposed on the upper end of the frontward side of the housing main body 2*a*. Specifically, the frontward-side opening/closing cover 9 is capable of pivoting from a closed position (the states in FIGS. 1 and 2) in which it covers the area above the third storage part 4, to an open position (the states in FIGS. 3 and 4) in which it exposes that area.

Print-Receiving Tape Roll and Surrounding Area Thereof

Figure 4:
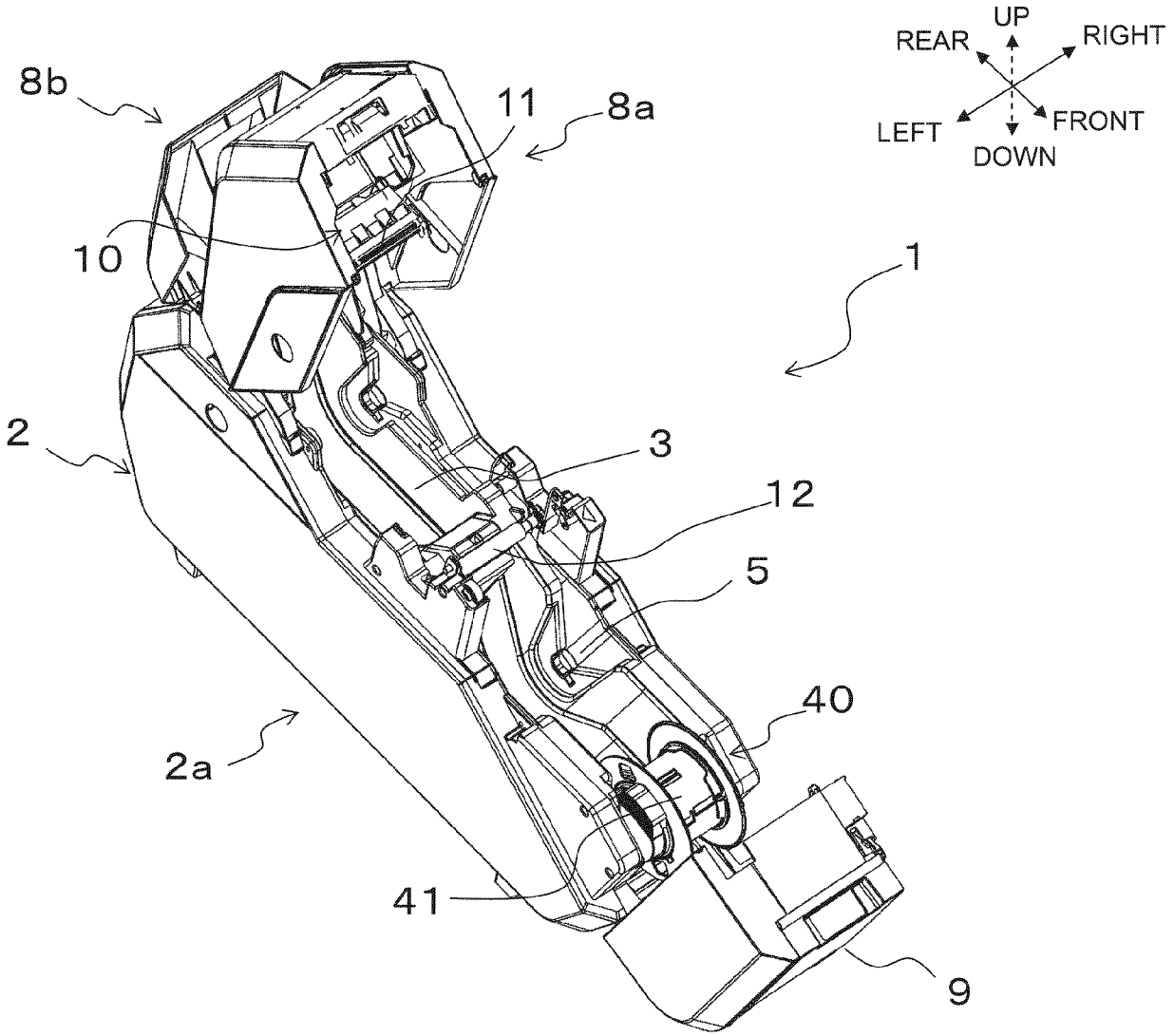
FIG. 4 is a perspective view showing the tape printer with the first, second, and frontward-side opening/closing covers open and the tape cartridge and ink ribbon cartridge removed.

At this time, as shown in FIGS. 2-4, a tape cartridge TK (refer to FIG. 2) is detachably mounted in a first predetermined position 13 below the frontward-side opening/closing cover 9 (when closed) of the housing main body 2*a*. This tape cartridge TK comprises a first roll R1 wound around and formed on an axis O1.

Figure 5:
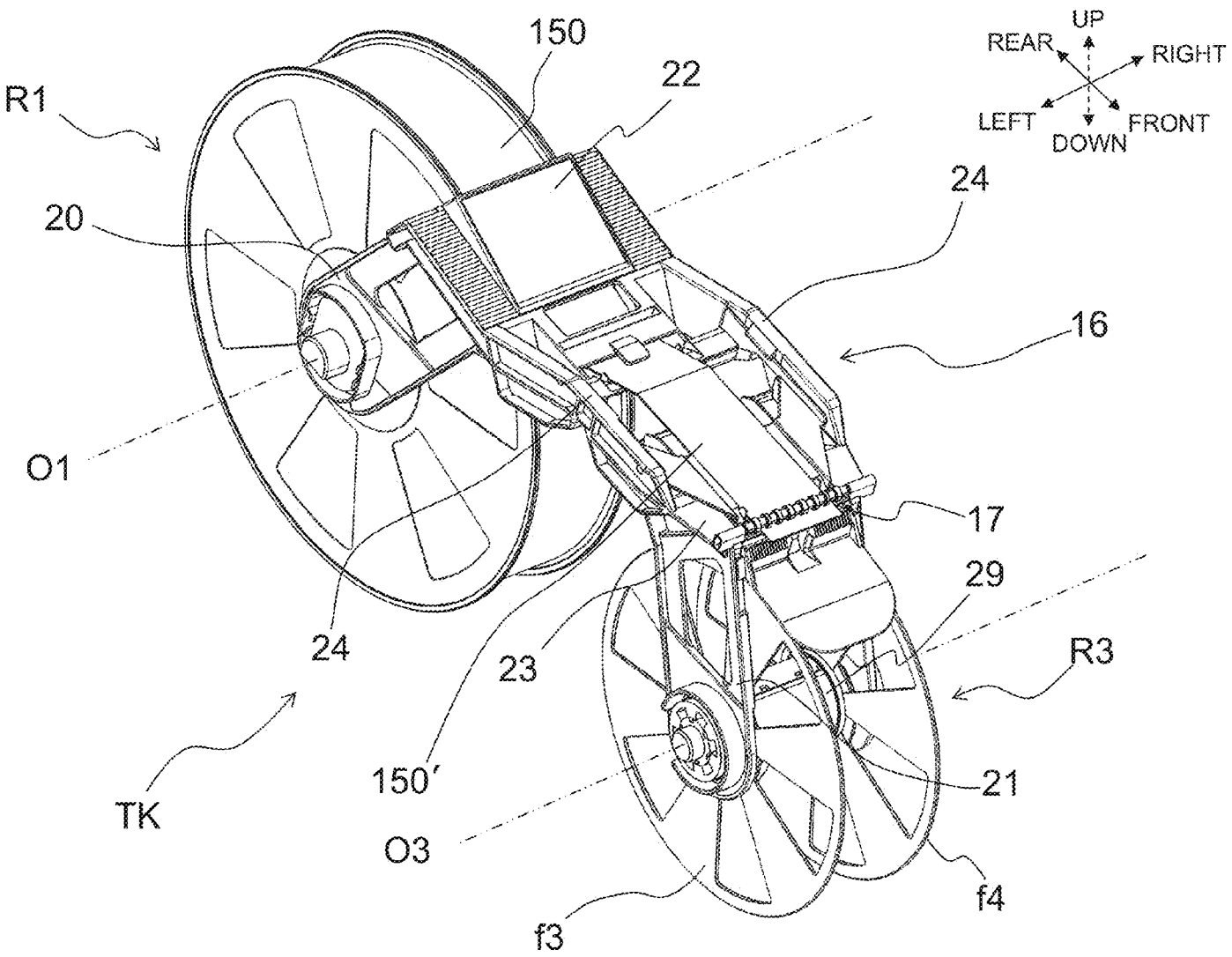
FIG. 5 is a perspective view showing the overall configuration of the tape cartridge.

That is, the tape cartridge TK comprises the first roll R1 and a coupling arm 16, as shown in FIG. 5. The coupling arm 16 comprises a left and right pair of first bracket parts 20, 20 disposed on the rearward side, and a left and right pair of second bracket parts 21, 21 disposed on the frontward side.

The first bracket parts 20, 20 are set so that the above described first roll R1 is sandwiched from both the left and right sides along the axis O1, holding the first roll R1 rotatably around the axis O1 with the tape cartridge TK mounted to the housing main body 2*a*. These first bracket parts 20, 20 are connected by a first connecting part 22 that is extended substantially along the left-right direction on the upper end, avoiding interference with the outer diameter of the first roll R1.

The first roll R1 is rotatable when the tape cartridge TK is mounted in the interior of the housing main body 2*a*. The first roll R1 winds a print-receiving tape 150 (comprising a print-receiving layer 154, a base layer 153, an adhesive layer 152, and a separation material layer 151 described later; refer to the enlarged view in FIG. 2) consumed by feed-out around the axis O1 in the left-right direction in advance.

The first roll R1 is received in the first storage part 3 from above by the mounting of the above described tape cartridge TK and stored with the axis O1 of the winding of the print-receiving tape 150 in the left-right direction. Then, the first roll R1, stored in the first storage part 3 (with the tape cartridge TK mounted), rotates in a predetermined rotating direction (a direction A in FIG. 2) inside the first storage part 3, thereby feeding out the print-receiving tape 150.

This embodiment illustrates a case where a print-receiving tape 150 comprising adhesive is used. That is, the print-receiving tape 150 is layered in the order of the print-receiving layer 154, the base layer 153, the adhesive layer 152, and the separation material layer 151, from one side in the thickness direction (upward side in FIG. 2) toward the other side (downward side in FIG. 2). The print-receiving layer 154 is a layer in which a desired print part 155 (refer to the enlarged partial view in FIG. 2) is formed by the heat transfer of ink from the above described printing head 11. The adhesive layer 152 is a layer for affixing the base layer 153 to a suitable adherent (not shown). The separation material layer 151 is a layer that covers the adhesive layer 152.

Feeding Roller and Printing Head

Returning to FIGS. 2-4, the above described feeding roller 12 is disposed on a middle upward side of the first storage part 3 and the second storage part 5 of the housing main body 2*a*. The feeding roller 12 is driven by a feeding motor M1 disposed in the interior of the housing main body 2*a* via a gear mechanism (not shown), thereby feeding the print-receiving tape 150 fed out from the first roll R1 stored in the first storage part 3 in a tape posture in which the tape width direction is in the left-right direction.

Further, the above described head holding part 10 disposed on the first opening/closing cover 8*a* comprises the above described printing head 11. The printing head 11, as described above, is capable of moving relatively closer to or farther away from the feeding roller 12 by the pivoting of the first opening/closing cover 8*a* around the pivot axis K1. That is, the printing head 11 moves closer to the feeding roller 12 when the first opening/closing cover 8*a* is closed, and farther away from the feeding roller 12 when the first opening/closing cover 8*a* is opened. This printing head 11 is disposed in a position of the head holding part 10 that faces the area above the feeding roller 12, with the first opening/closing cover 8*a* closed, sandwiching the print-receiving tape 150 fed by the feeding roller 12 in coordination with the feeding roller 12. Accordingly, when the first opening/closing cover 8*a* is closed, the printing head 11 and the feeding roller 12 are disposed facing each other in the up-down direction. Then, the printing head 11 forms the above described print part 155 on the print-receiving layer 154 of the print-receiving tape 150 sandwiched between the printing head 11 and the feeding roller 12 using an ink ribbon IB of an ink ribbon cartridge RK described later, thereby forming a tape 150' with print.

Ink Ribbon Cartridge

As shown in FIG. 2 and FIG. 3, the ink ribbon cartridge RK is detachably mounted in a second predetermined position 14, which is below the first opening/closing cover 8*a* (when closed) and above the tape cartridge TK in the housing main body 2*a*. This ink ribbon cartridge RK comprises a ribbon feed-out roll R4 around which is wound the unused ink ribbon IB in manner that enables feed-out, and a ribbon take-up roll R5. The ink ribbon cartridge RK couples a rearward-side feed-out roll storage part 81 and a frontward-side take-up roll storage part 82 by a center coupling part (not shown). The coupling part couples the above described take-up roll storage part 82 and the above described feed-out roll storage part 81 while exposing the above described ink ribbon IB fed out from the ribbon feed-out roll R4 to the outside of the ink ribbon cartridge RK.

The ribbon feed-out roll R4 is rotatably supported inside the feed-out roll storage part 81, and rotates in a predetermined rotating direction (a direction D in FIG. 2) with the ink ribbon cartridge RK mounted, thereby feeding out the ink ribbon IB for print formation by the printing head 11.

The ribbon take-up roll R5 is rotatably supported inside the take-up roll storage part 82 and rotates in a predetermined rotating direction (a direction E in FIG. 2) with the ink ribbon cartridge RK mounted, thereby taking up the used ink ribbon IB after print formation.

That is, in FIG. 2, the ink ribbon IB fed out from the ribbon feed-out roll R4 is disposed further on the printing head 11 side of the print-receiving tape 150 sandwiched between the printing head 11 and the feeding roller 12, contacting the area below the printing head 11. Then, after the ink of an ink ribbon IB is transferred to the print-receiving layer 154 of the print-receiving tape 150 by the heat from the printing head 11 to execute formation of the print part 155, the used ink ribbon IB is taken up on the ribbon take-up roll R5.

Separation Material Roll and Surrounding Area Thereof

As shown in FIG. 5, the coupling arm 16 of the tape cartridge TK comprises a peeling part 17 that includes a substantially horizontal slit shape, for example. This peeling part 17 is an area that peels the separation material layer 151 from the tape 150' with print fed out from the first roll R1 and fed to the frontward side. As shown in FIG. 2, the above described peeling part 17 peels the above described separation material layer 151 from the tape 150' with print on which print was formed as described above, thereby separating the separation material layer 151 and a tape 150" with print made of the other layers, i.e., the print-receiving layer 154, the base layer 153, and the adhesive layer 152.

The tape cartridge TK, as shown in FIG. 2 and FIG. 5, comprises a third roll R3 formed by winding the above described peeled separation material layer 151 around an axis O3. That is, the third roll R3 is received in the above described second storage part 5 from above by the mounting of the aforementioned tape cartridge TK and stored with the axis O3 for winding the separation material layer in the left-right direction. Then, the third roll R3, stored in the second storage part 5 (with the tape cartridge TK mounted), is driven by a separation sheet take-up motor M3 that is disposed inside the housing main body 2*a* via a gear mechanism (not shown) and rotates in a predetermined rotating direction (a direction C in FIG. 2) inside the second storage part 5, thereby taking up the separation material layer 151.

At this time, as shown in FIG. 5, the above described second bracket parts 21, 21 of the tape cartridge TK are set so that the above described third roll R3 is sandwiched from both the left and right sides along the axis O3, holding the third roll R3 rotatably around the axis O3 with the tape cartridge TK mounted to the housing main body 2*a*. These second bracket parts 21, 21 are connected by a second connecting part 23 extended substantially along the left-right direction on the upper end. Then, the first bracket parts 20, 20 and the first connecting part 22 on the rearward side, and the second bracket parts 21, 21 and the second connecting part 23 on the frontward side are coupled by a left and right pair of roll coupling beam parts 24, 24.

Further, FIG. 5 shows the state before the separation material layer 151 is wound around the axis O3 and the third roll R3 is formed (the case of the unused tape cartridge TK). That is, FIG. 5 shows substantially circular roll flange parts f3, f4 disposed so as to sandwich both width-direction sides of the separation material layer 151, and conveniently denotes the location where the third roll R3 is formed using the reference number "R3."

Tape Roll with Print and Surrounding Area Thereof

On the other hand, as shown in FIG. 2 and FIG. 4, a take-up mechanism 40 for sequentially winding the above described tape 150" with print is received in the above described third storage part 4 from above. The take-up mechanism 40 is stored so that it is supported rotatably around an axis O2 with the axis O2 of the winding of the tape 150" with print in the left-right direction. Then, the take-up mechanism 40, stored in the third storage part 4, is driven by an adhesive take-up motor M2 that is disposed in the interior of the housing main body 2*a* via a gear mechanism (not shown) and rotates in a predetermined rotating direction (a direction B in FIG. 2) inside the third storage part 4, taking up and layering the tape 150" with print. With this arrangement, the tape 150" with print is sequentially wound around the outer circumference side of the take-up mechanism 40, forming a second roll R2.

Cutter Mechanism

Further, as shown in FIG. 2, a cutter mechanism 30 is disposed on the downstream side of the printing head 11 and the upstream side of the second roll R2, along the tape transport direction.

The cutter mechanism 30, while not shown in detail, comprises a movable blade and a carriage that supports the movable blade and is capable of travelling in the tape width direction (in other words, the left-right direction). Then, the carriage travels by the driving of a cutter motor MC (refer to FIG. 6 described later) and the movable blade moves in the tape width direction, cutting the above described tape 150" with print in the width direction.

Overview of Operation of Tape Printer

Next, an overview of the operation of the tape printer 1 with the above described configuration will be described.

That is, when the tape cartridge TK is mounted in the above described first predetermined position 13, the first roll R1 is stored in the first storage part 3 positioned on the rearward side of the housing main body 2*a*, and the axis O3 side that forms the third roll R3 is stored in the second storage part 5 positioned on the frontward side of the housing main body 2*a*. Further, the take-up mechanism 40 for forming the second roll R2 is stored in the third storage part 4 positioned on the frontward side of the housing main body 2*a*.

At this time, when the feeding roller 12 is driven, the print-receiving tape 150 fed out by the rotation of the first roll R1 stored in the first storage part 3 is fed to the frontward side. Then, desired print is formed by the printing head 11 on the print-receiving layer 154 of the print-receiving tape 150 thus fed, thereby forming the tape 150' with print. When the tape 150' with print on which print was formed is further fed to the frontward side and fed to the peeling part 17, the separation material layer 151 is peeled at the peeling part 17, forming the tape 150" with print. The peeled separation material layer 151 is fed to the downward side, introduced to and wound inside the second storage part 5, forming the third roll R3.

On the other hand, the tape 150" with print from which the separation material layer 151 was peeled is further fed to the frontward side, introduced to the third storage part 4, and wound on the outer circumference side of the take-up mechanism 40 inside the third storage part 4, thereby forming the second roll R2. At this time, the cutter mechanism 30 disposed on the transport direction downstream side (that is, the frontward side) cuts the tape 150" with print. With this arrangement, the tape 150" with print wound around the second roll R2 can be cut based on a timing desired by the user and the second roll R2 can be removed from the third storage part 4 after cutting.

Note that, at this time, although not explained by illustration, a non-adhesive tape (without the above described adhesive layer 152 and separation material layer 151) may be wound around the first roll R1. In this case as well, the first roll R1 which winds the non-adhesive tape is received in the first storage part 3 from above by the mounting of the tape cartridge TK and stored with the axis O1 of the winding of the non-adhesive tape in the left-right direction. Then, the first roll R1, stored in the first storage part 3 (with the tape cartridge TK mounted), rotates in a predetermined rotating direction (the direction A in FIG. 2) inside the first storage part 3, thereby feeding out the non-adhesive tape.

Further, at this time, a shoot 15 (refer to FIG. 2) for switching the feeding path of the above described non-adhesive tape (or the above described print-receiving tape 150) between a side toward the second roll R2 and a side toward the discharging exit (not shown) may be disposed. That is, the non-adhesive tape after print formation (or the tape 150" with print) may be discharged as is from the discharging exit (not shown) disposed on the second opening/closing cover 8*b* side, for example, of the housing 2 to the outside of the housing 2 without being wound inside the third storage part 4 as described above by switching the tape path by a switch operation of the shoot 15 using a switch lever (not shown).

Control System

Figure 6:
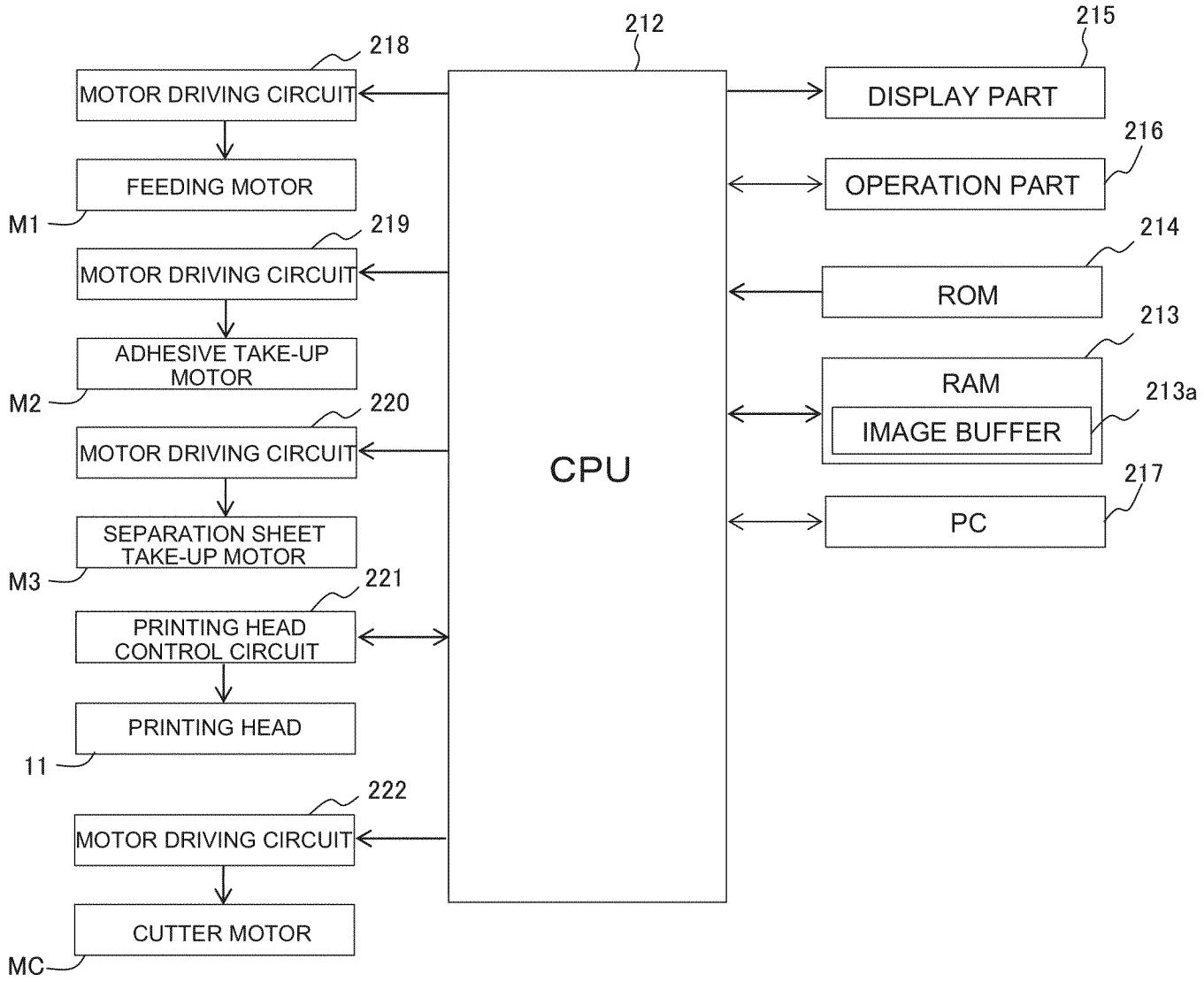
FIG. 6 is a function block diagram showing the configuration of the control system of the tape printer.

Next, the control system of the tape printer 1 will be described using FIG. 6. In FIG. 6, the tape printer 1 comprises a CPU 212 that constitutes a computing part that performs predetermined computations. The CPU 212 is connected to a RAM 213 and a ROM 214. The CPU 212 performs signal processing in accordance with a program stored in advance in the ROM 214 while utilizing a temporary storage function of the RAM 213, and controls the entire tape printer 1 accordingly.

Further, the CPU 212 is connected to a motor driving circuit 218 that controls the driving of the above described feeding motor M1 that drives the above described feeding roller 12, a motor driving circuit 219 that controls the driving of the above described adhesive take-up motor M2 that drives the above described second roll R2, a motor driving circuit 220 that controls the driving of the above described separation sheet take-up motor M3 that drives the above described third roll R3, a printing head control circuit 221 that controls the current conduction of the heating elements (not shown) of the above described printing head 11, a motor driving circuit 222 that controls the driving of the cutter motor MC that causes the carriage comprising the above described movable blade to travel, a display part 215 that performs suitable displays, and an operation part 216 that permits suitable operation input by the user. Further, while the CPU 212 is connected to the PC 217 serving as an external terminal in this example, the CPU 212 does not need to be connected in a case where the tape printer 1 operates alone (since it is a so-called stand-alone type).

The ROM 214 stores control programs for executing predetermined control processing (including programs that execute the flow processing in FIG. 14 and FIG. 13 described later). The RAM 213 comprises an image buffer 213*a* that expands print data (refer to step S204 described later) generated in correspondence with an operation of the above described operation part 216 (or the above described PC 217) by the user into dot pattern data for printing in a predetermined print area of the above described print-receiving layer 154, and stores the data, for example. The CPU 212 repeatedly prints one image corresponding to the above described dot pattern data stored in the image buffer 213*a* on the print-receiving tape 150 by the printing head 11 while feeding out the print-receiving tape 150 by the feeding roller 12, based on the above described control programs.

In the above, the special characteristic of this embodiment lies in the technique for suppressing the occurrence of defective products when the second roll R2 is generated by the adhesive tape 150" with print as described above. In the following, details on the functions will be described in order.

COMPARISON EXAMPLE

Figure 7A:
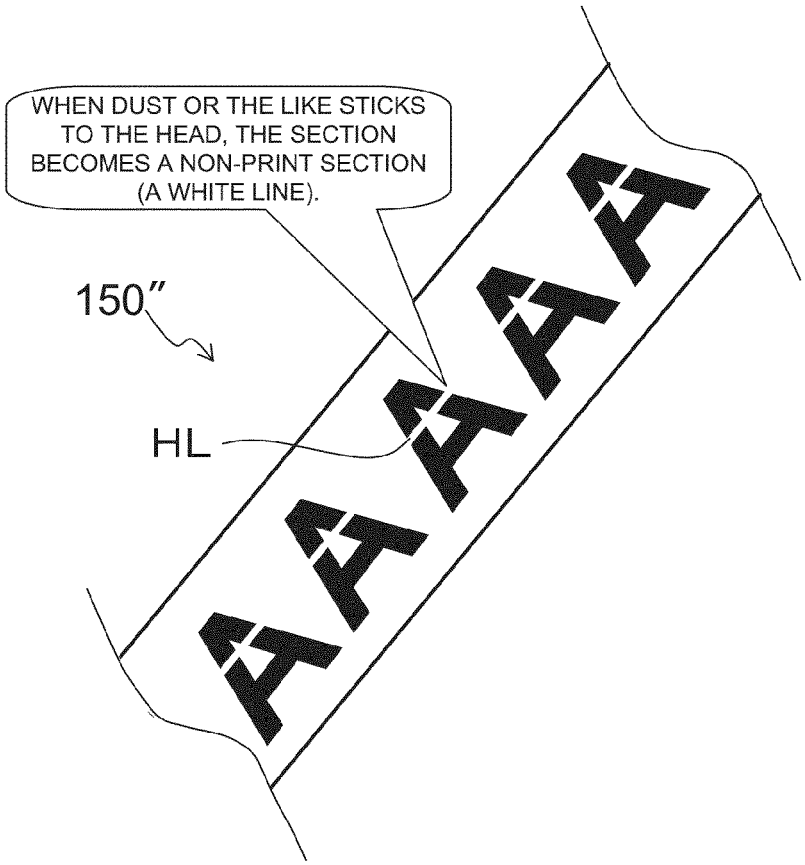
FIG. 7A is a perspective view of a tape with print of a generated second roll in a comparison example of an embodiment of the present disclosure.
Figure 7B:
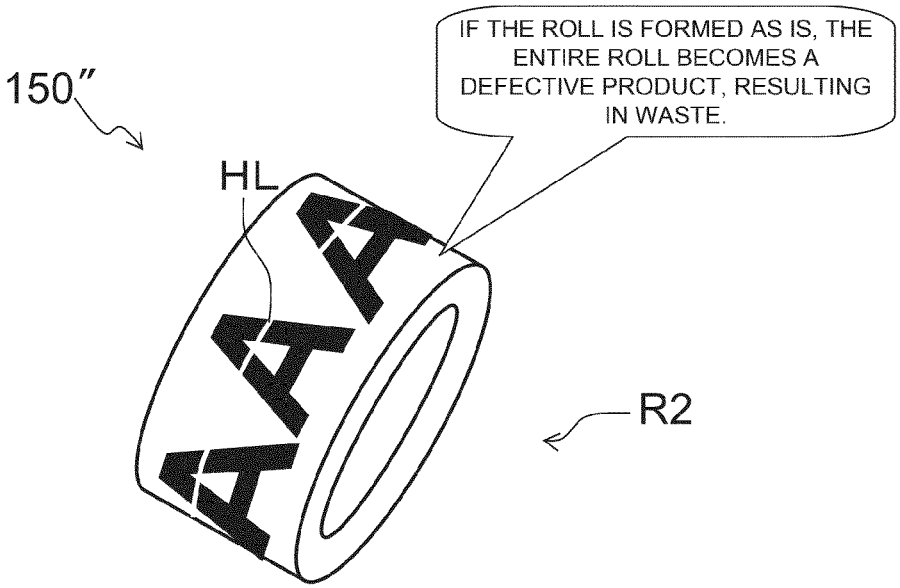
FIG. 7B is a perspective view in the comparison example of an embodiment of the present disclosure.

As described above, in a case where print formation is performed by the printing head 11, faint print or the like may occur due to attached matter, such as dust, on the printing head 11 or nearby area, for example, causing a decrease in print quality. For example, as a comparison example of this embodiment, when dust or the like sticks to the printing head 11 or nearby area, the above described faint print or partial omission may occur in a section (a portion of the characters "AAA" in this example) of print formation corresponding to the above described stuck section on the above described tape 150" with print, resulting in a so-called white line HL (non-print section; refer to FIG. 10A and FIG. 10B as well described later), as shown in FIG. 7A. Then, if the second roll R2 is produced by take-up of the tape 150" with print as described above and the above described white line is found after production of the second roll R2 as shown in FIG. 7B, the second roll R2 generated by take-up becomes an entirely defective product, resulting in waste.

OVERVIEW OF TECHNIQUE OF EMBODIMENT

Hence, according to this embodiment, whether or not the print quality has decreased due to the occurrence of the white line HL or the like can be visually confirmed before production of the second roll R2 is actually started. Specifically, according to this embodiment, as shown in the above described FIG. 1, a rectangular visual confirmation window 300 that enables visual confirmation of the tape 150" with print taken up by the take-up mechanism 40 is disposed near the frontward-side end of the frontward-side opening/closing cover 9 (not shown, however, in the above described FIG. 2 to prevent complexities in illustration). Then, after a predetermined test pattern S (refer to FIG. 10, FIG. 11, and the like described later) is formed into print on the print-receiving tape 150 by the printing head 11, tape take-up and feeding are performed, and the area where the above described test pattern S of the tape 150" with print is formed arrives and stops near the visual confirmation window 300. Then, the user visually confirms the quality of the test pattern S from outside the apparatus, making it possible to visually confirm whether or not the print quality has decreased due to the occurrence of the above described white line HL or the like.

Note that the formation of the above described test pattern S and feeding operation to the visually confirmable position, according to this embodiment, are executed after predetermined preparation processing (details described later). The tape feeding and take-up behavior in this embodiment, including this preparation processing, will now be described using FIGS. 8-12.

Preparation Processing

Figure 8A:
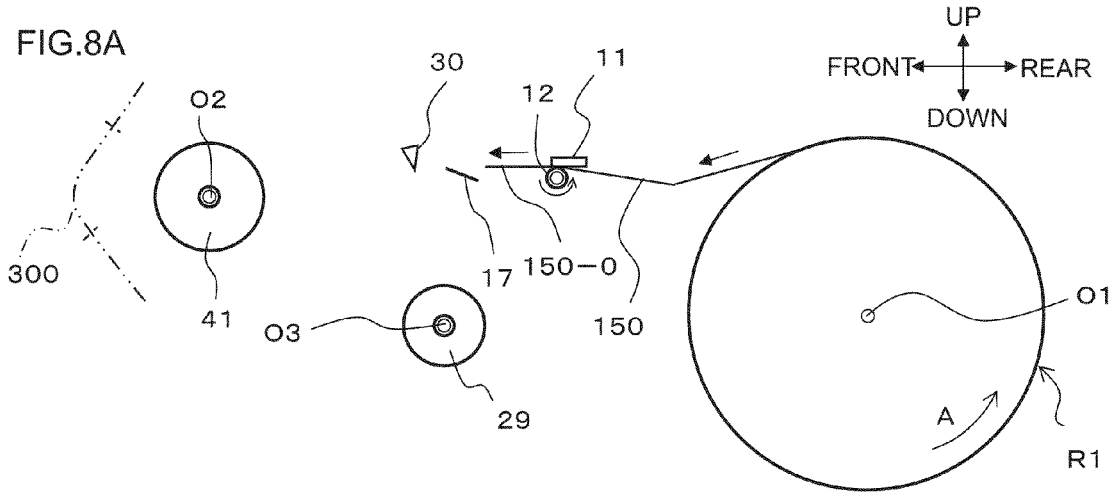
FIG. 8A is an explanatory view showing the tape feeding, take-up behavior, and the like in preparation processing.
Figure 8B:
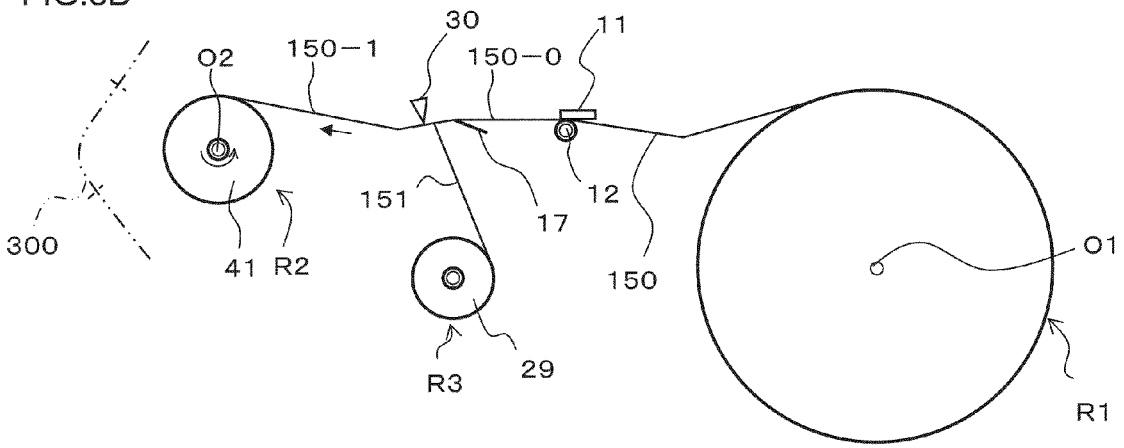
FIG. 8B is an explanatory view showing the tape feeding, take-up behavior, and the like in preparation processing.
Figure 8C:
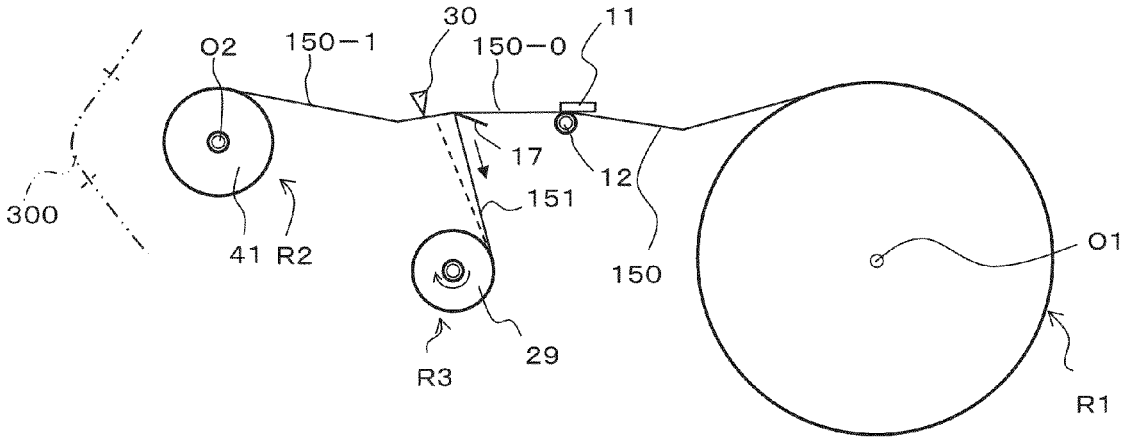
FIG. 8C is an explanatory view showing the tape feeding, take-up behavior, and the like in preparation processing.

According to this embodiment, before print is formed by the printing head 11 such as described above, the above described preparation processing for removing the slack of the print-receiving tape 150 is performed. FIGS. 8A-8C schematically show this preparation processing step.

First, the user manually feeds out the print-receiving tape 150 from the first roll R1 of the tape cartridge TK, and passes the fed out print-receiving tape 150 between the feeding roller 12 and the printing head 11 (refer to FIG. 8A). At this time, the CPU 212 controls the feeding motor M1 for a predetermined period of time so that the feeding roller 12 is rotated in the transport direction. Note that the print-receiving tape 150 passed between the feeding roller 12 and the printing head 11 and advanced to the downstream side thereof in this manner is referred to as a tape 150-0 for convenience of explanation. This tape 150-0 is an area corresponding to the tape 150' with print after the start of print formation (including formation of the test pattern S) by the printing head 11 described later.

Subsequently, the user manually peels the separation material layer 151 from the above described tape 150-0, and secures the tip end of a tape 150-1 made of the base layer 153 and the adhesive layer 152 to a winding core 41 (refer to FIG. 4) of the take-up mechanism 40 for forming the second roll R2. Note that this tape 150-1 is an area corresponding to the tape 150" with print after the start of print formation (including formation of the test pattern S) by the printing head 11 described later. With the above described securement, the above described second roll R2 is formed by the winding of the tape 150-1 and the above described tape 150" with print with the rotation of the winding core 41 thereafter. On the other hand, the user secures the tip end of the separation material layer 151 peeled from the tape 150-0 to a winding core 29 (refer to FIG. 5) for forming the third roll R3 (refer to FIG. 8B). With this arrangement, the above described third roll R3 is formed by the winding of the separation material layer 151 with the rotation of the winding core 29 thereafter.

In this state, the CPU 212 stops the feeding roller 12 for a predetermined period of time and controls the feeding motor M1 and the adhesive take-up motor M2 so that only the above described winding core 41 is rotated in the take-up direction (refer to FIG. 8B). With this arrangement, the above described tape 150-1 from which the separation material layer 151 was peeled is pulled by the stopped feeding roller 12 and the winding core 41 that rotates in the take-up direction and, at the moment that the slack is removed, the rotation of the winding core 41 stops, causing tension to be applied to the tape 150-1. Note that, if rotation of the winding core 41 is detected at the moment that tension is to be applied to the tape 150-1 in this manner, the winding core 41 (in other words, the second roll R2) is regarded as rotating idly since the tip end of the tape 150-1 is not well secured to the winding core 41, and a defect is reported (refer to step S135 and step S190 described later).

Next, the CPU 212 stops the feeding roller 12 for a predetermined period of time and controls the feeding motor M1 and the separation sheet take-up motor M3 so that only the above described winding core 29 is rotated in the take-up direction (refer to FIG. 8C). With this arrangement, the separation material layer 151 peeled from the tape 150-0 is pulled by the stopped feeding roller 12 and the winding core 29 (in other words, the third roll R3) that rotates in the take-up direction and, at the moment that the slack is removed, the rotation of the winding core 29 stops, causing tension to be applied to the tape 150-0. Further, at this time, even if the separation point between the tape 150-0 and the separation material layer 151 has moved by the retraction of the tape 150-0 due to the rotation of the above described second roll R2 only, the point can be returned to its original position (refer to the broken line in FIG. 8C). Note that, if rotation of the third roll R3 is detected at the moment that tension is to be applied to the separation material layer 151 in this manner, the third roll R3 is regarded as rotating idly since the tip end of the separation material layer 151 is not well secured to the above described winding core 29, and a defect is reported (refer to step S155 and step S198 described later).

Next, the CPU 212 controls the feeding motor M1, the adhesive take-up motor M2, and the separation sheet take-up motor M3 for a predetermined period of time so as to rotate the feeding roller 12, the second roll R2, as well as the third roll R3 (without performing a print operation; not particularly shown). With this final verification operation, it is possible to verify in advance whether or not the series of operations including the feed-out and feeding of the print-receiving tape 150, the feeding of the tape 150-0, the feeding and take-up of the tape 150-1, the peeling and take-up of the separation material layer 151, and the like are normally performed.

Formation of Test Pattern

Figure 9A:
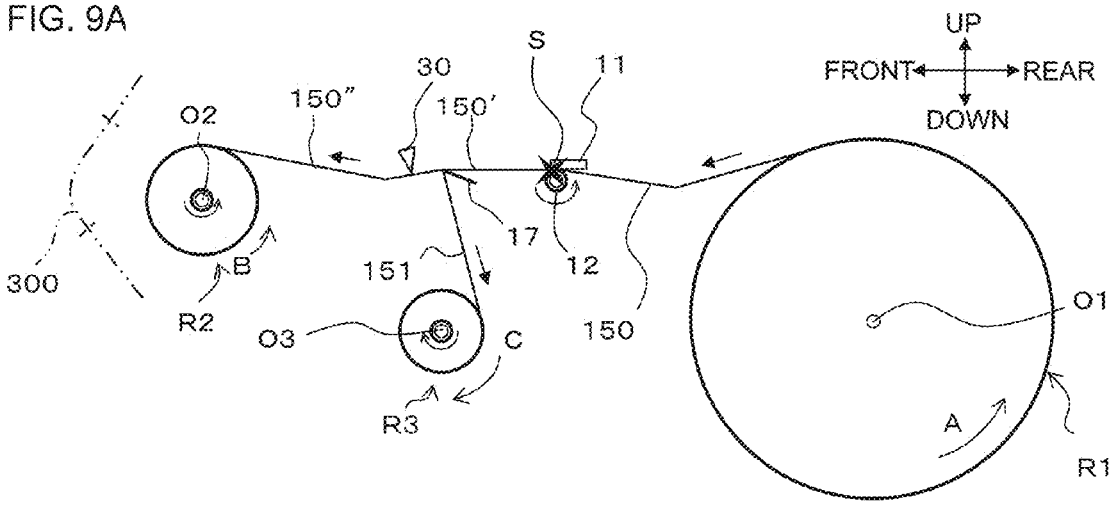
FIG. 9A is an explanatory view showing the tape feeding, print formation, tape take-up behavior, and the like during formation of the test pattern.

After the above described preparation processing, formation of the above described test pattern S is performed before production of the above described printed matter resulting from desired print formation by the printing head 11, such as already described. That is, after the above described preparation processing shown in the above described FIG. 8C, the feed-out and feeding of print-receiving tape 150 such as described above, the generation and feeding of the tape 150' with print by print formation of the test pattern S (the star mark indicates the formation position of the test pattern S) on the print-receiving tape 150, the generation of the tape 150" with print by the peeling of the separation material layer 151 from the tape 150' with print and the take-up of the peeled separation material layer 151, and the feeding and take-up of the tape 150" with print are started, as shown in FIG. 9A.

Figure 10B:
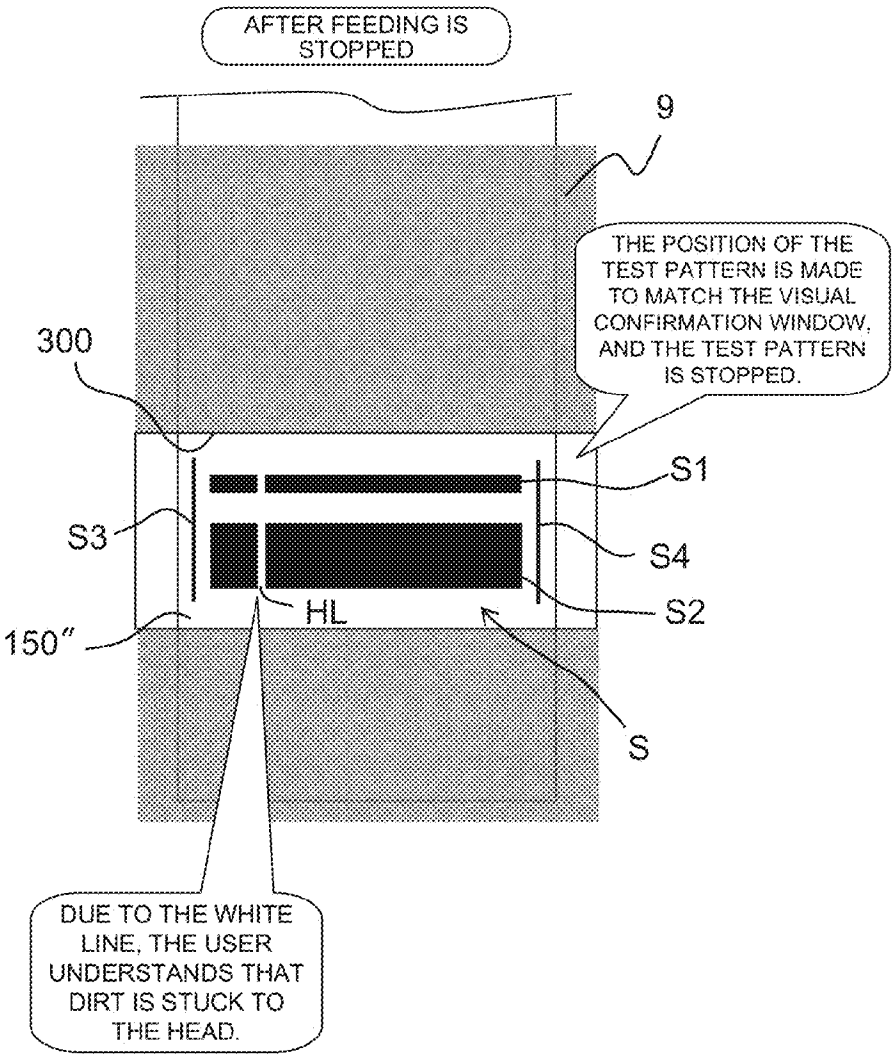
FIG. 10B is an explanatory view showing the feeding of the tape with print stopped, in the case where a white line occurs in the test pattern.
Figure 10A:
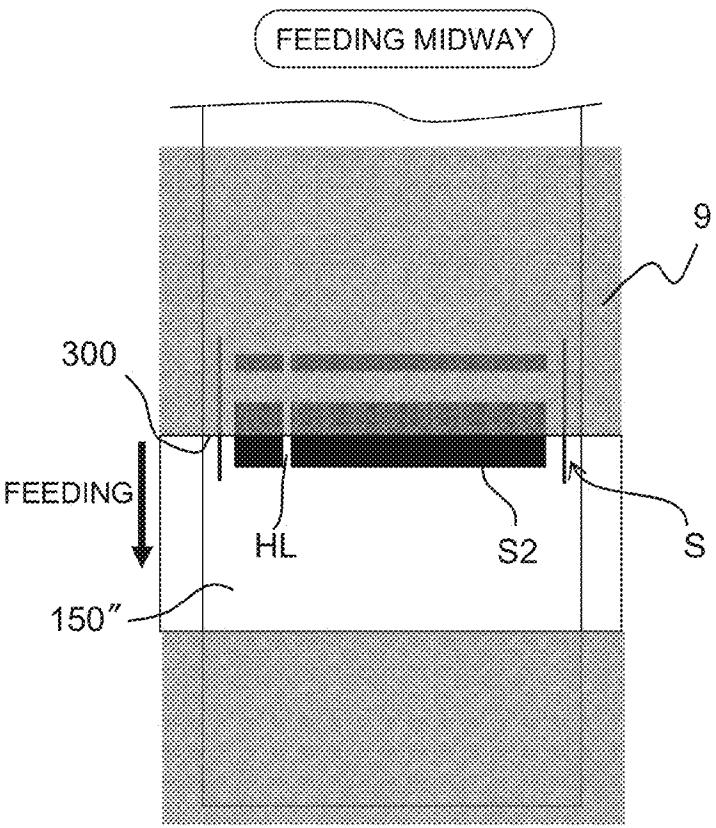
FIG. 10A is an explanatory view showing the feeding of the tape with print midway, in a case where a white line occurs in the test pattern.

Subsequently, with the continued the feeding of the above described print-receiving tape 150, tape 150' with print, and tape 150" with print, the formed above described test pattern S proceeds to the transport direction downstream side and enters a midway state in which a portion thereof is visible from the visual confirmation window 300, as shown in FIG. 10A. Furthermore, subsequently, as shown in FIG. 10B, when the position of the test pattern S substantially matches the visual confirmation window 300, the feeding of the tape 150' with print and the tape 150" with print is stopped. At this time, print formation other than that of the test pattern S by the printing head 11 is not performed.

Figure 9B:
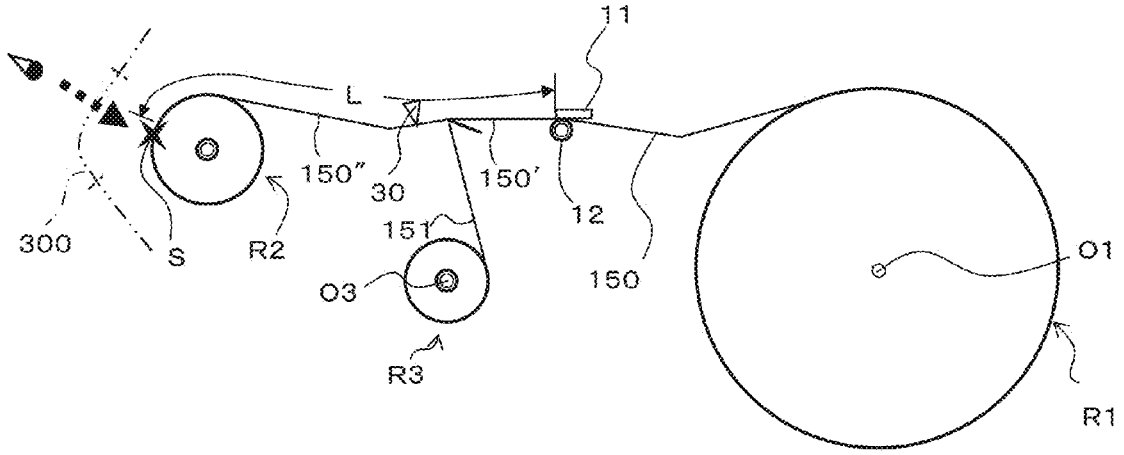
FIG. 9B is an explanatory view showing the tape feeding, print formation, tape take-up behavior, and the like during formation of the test pattern.

During the period until the above described stopping of feeding, after the printing of the test pattern S is performed as described above, the above described feeding is performed by a distance L (a fixed value, for example) along a transport direction from the printing head 11 to a position of the second roll R2 outer circumference part that faces the visual confirmation window 300 (refer to FIG. 9B). That is, the CPU 212 controls the feeding motor M1, the adhesive take-up motor M2, and the separation sheet take-up motor M3 so that the feeding by the above described distance L is performed by the rotation of the above described feeding roller 12, second roll R2, and third roll R3.

The above described FIG. 10A and FIG. 10B are an example of a case where the above described white line HL occurs in the test pattern S formed on the tape 150" with print. In this example, the test pattern S is a pattern that includes a thick line S1 that extends in the tape width direction, a thin line S2 that extends in the tape width direction, and end lines S3, S4 that extend in the tape transport direction on both tape width direction sides of the lines S1, S2, respectively. In this example, the lengths of the lines S1, S2 in the tape width direction are substantially the same. Further, a width D between the above described end lines S3, S4 is substantially the same as the tape width direction dimension (more accurately, the tape width direction dimension in the region heated by the heating elements) of the printing head 11. Then, the white line HL occurs in the transport direction (the up-down direction shown in the figure) so as to be orthogonal to the lines S1, S2, and the line S1 and the line S2 are divided by the white line HL. If the user visually confirms the occurrence of the above described white line HL through the visual confirmation window 300 as shown in the figure, it is possible to recognize that dust or the like is stuck on the printing head 11. In such a case, the user can avoid the aforementioned waste by cleaning the printing head 11 or the like (without continuing production of the second roll R2 as is, for example), and then producing the second roll R2.

Figure 11B:
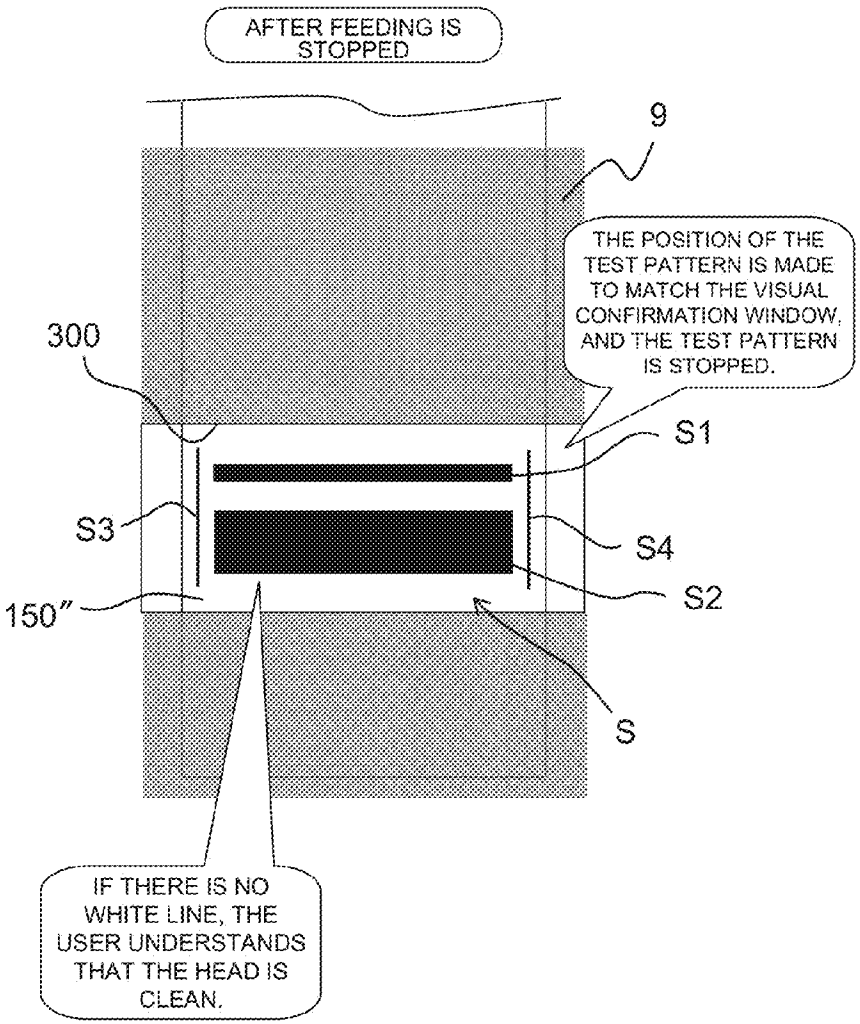
FIG. 11B is an explanatory view showing the feeding of the tape with print stopped, in the case where a white line does not occur in the test pattern.
Figure 11A:
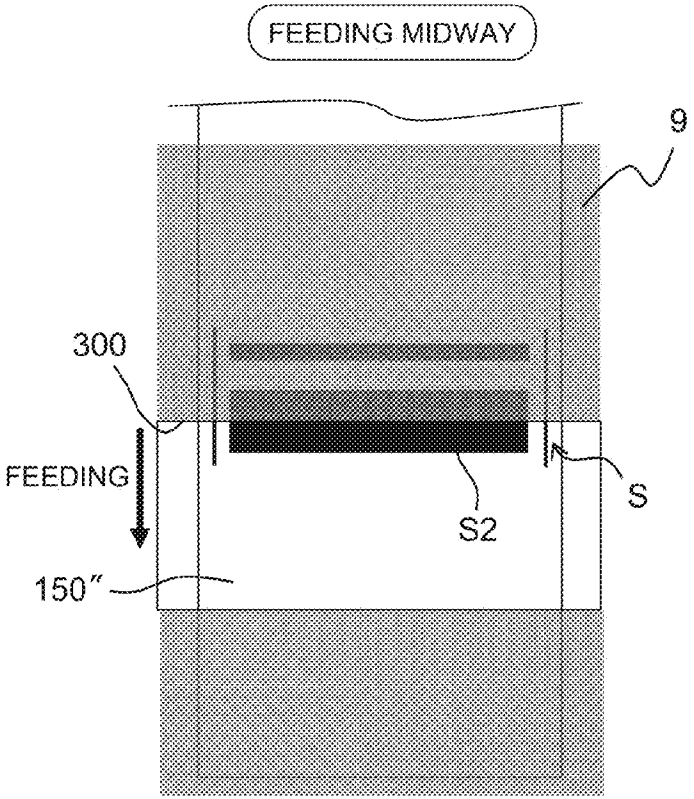
FIG. 11A is an explanatory view showing the feeding of the tape with print midway, in a case where a white line does not occur in the test pattern.

FIG. 11A and FIG. 11B respectively correspond to the above described FIG. 10A and FIG. 10B, and are an example of a case where the above described white line HL does not occur in the test pattern S formed on the tape 150" with print. In this case, unlike the above, the line S1 and the line S2 are not divided by the white line HL. If the user visually confirms non-occurrence of the above described white line HL through the visual confirmation window 300 as shown in the figure, the user can (regard the printing head 11 as clean and) continue production of the second roll R2 as is.

Printed Matter Production

Once the test pattern S having a clean print quality is visually confirmed as in the example shown in the above described FIG. 11A and FIG. 11B, the user performs a suitable work continuation instruction (refer to step S209 described later). As a result, as described above, the feed-out and feeding of the print-receiving tape 150, the generation and feeding of the tape 150' with print resulting from print formation on the print-receiving tape 150, the generation of the tape 150" with print resulting from the peeling of the separation material layer 151 from the tape 150' with print and the take-up of the peeled separation material layer 151, and the feeding and take-up of the tape 150" with print (hereinafter suitably collectively referred to as the "printed matter formation operation") are started. That is, from the state shown in the above described FIG. 9B, in the same manner as described above, the print-receiving tape 150 is fed by the feeding roller 12, desired print is formed on the fed print-receiving tape 150 by the printing head 11, and the tape 150' with print is formed. Further, the tape 150" with print resulting from the peeling of the separation material layer 151 from the tape 150' with print is sequentially taken up around the axis O2 by the take-up mechanism 40 (refer to FIG. 12A).

Figure 12A:
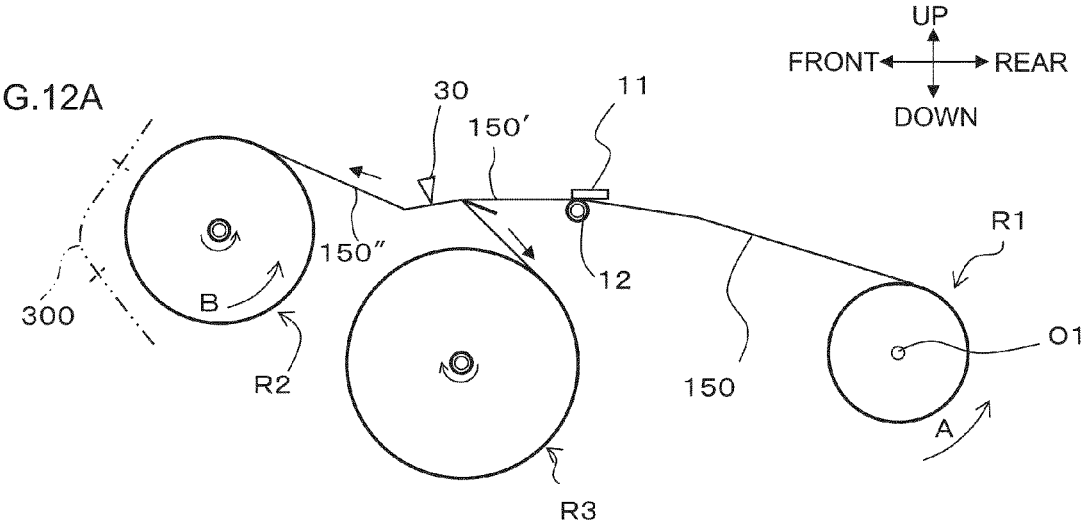
FIG. 12A is an explanatory view showing the tape feeding, cutting, take-up behavior, and the like during printed matter production.
Figure 12B:
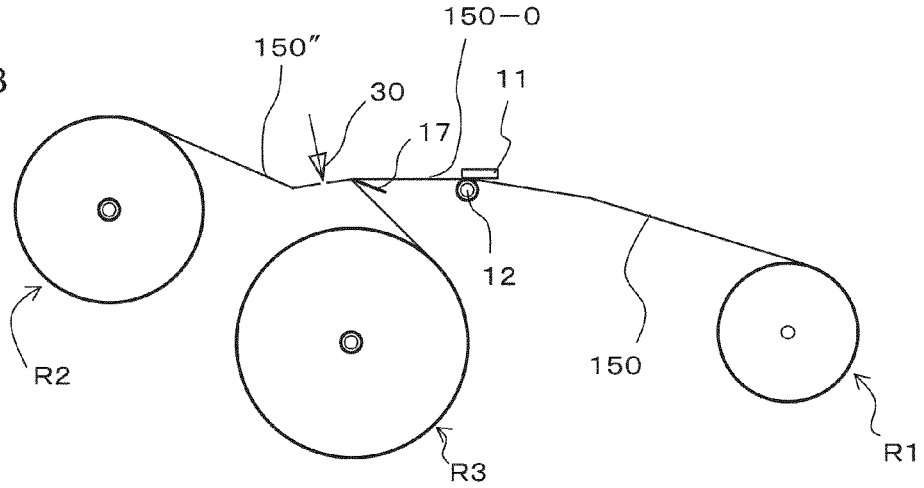
FIG. 12B is an explanatory view showing the tape feeding, cutting, take-up behavior, and the like during printed matter production.

Subsequently, the printed matter formation operation advances further from the state shown in the above described FIG. 12A and, once the print-receiving tape 150, the tape 150' with print, and the tape 150" with print are in a specific transport direction position (determined in advance before the start of the printed matter production operation), the rotation of the feeding roller 12, the second roll R2, as well as the third roll R3 is stopped as shown in FIG. 12B. As a result, the feed-out and feeding of the above described print-receiving tape 150, the feeding of the tape 150' with print, and the feeding and take-up of the tape 150" with print are stopped. Note that print formation is stopped in advance of the above described stop so that the area between the cutter mechanism 30 and the printing head 11 becomes the above described tape 150-0, which is a non-print section, in this stopped state. In this state, the cutter mechanism 30 cuts the tape 150" with print between the feeding roller 12 and the second roll R2 (refer to FIG. 12B).

Subsequently, the adhesive take-up motor M2 is controlled so that the second roll R2 stops after rotation for a predetermined amount of time in the take-up direction (with the feeding roller 12 stopped as is). That is, after completion of the cutting of the tape 150" with print by the cutter mechanism 30, the second roll R2 does not stop immediately, but rather after rotation for a predetermined amount of time. With this arrangement, the second roll R2 is rotated a predetermined amount after cutting completion, and the end edge of the tape 150" with print generated by cutting is reliably taken up on the second roll R2 (refer to FIG. 12C).

Control Flow

Figure 13:
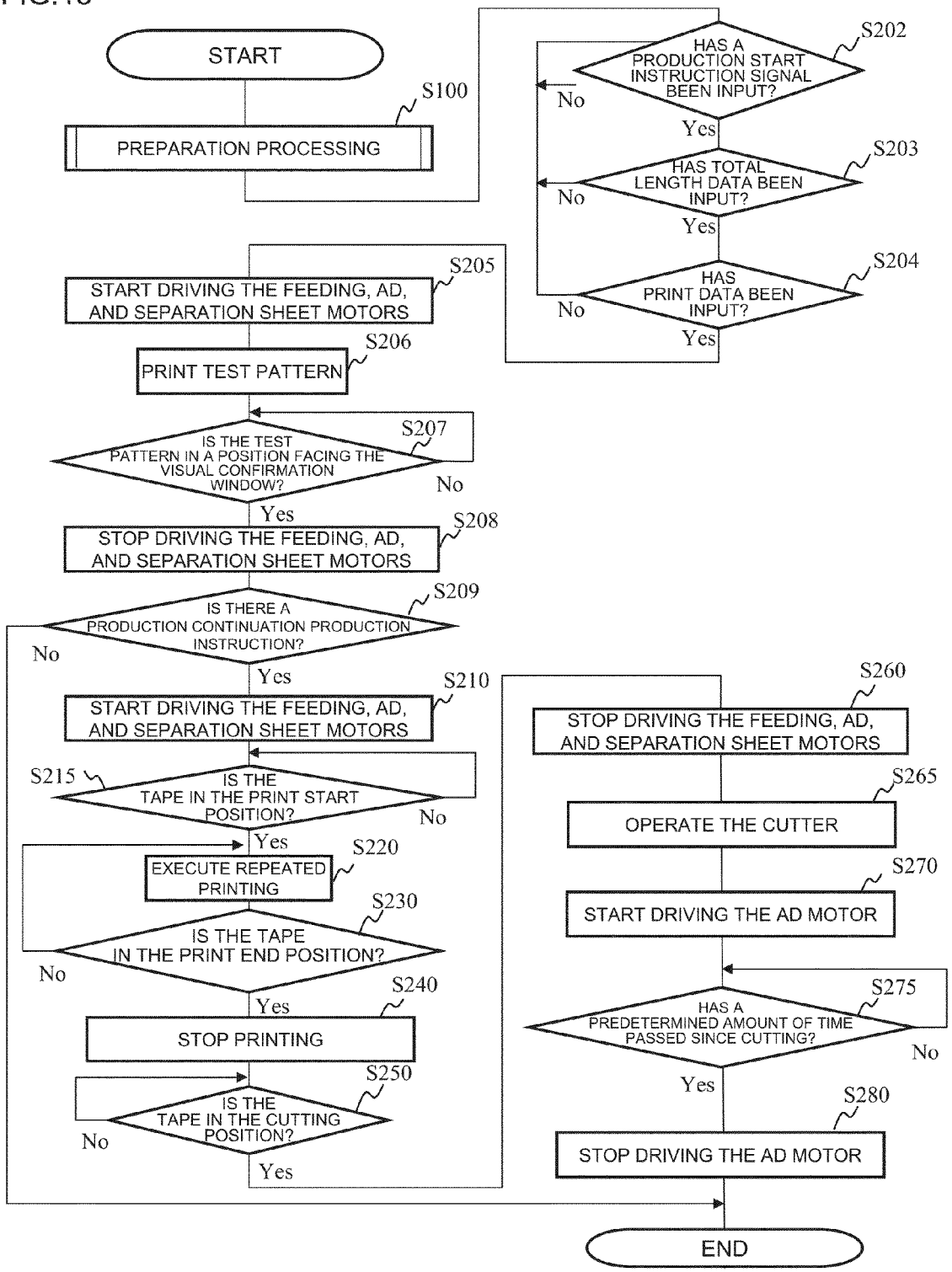
FIG. 13 is a flowchart showing the control procedure executed by the CPU.
Figure 14:
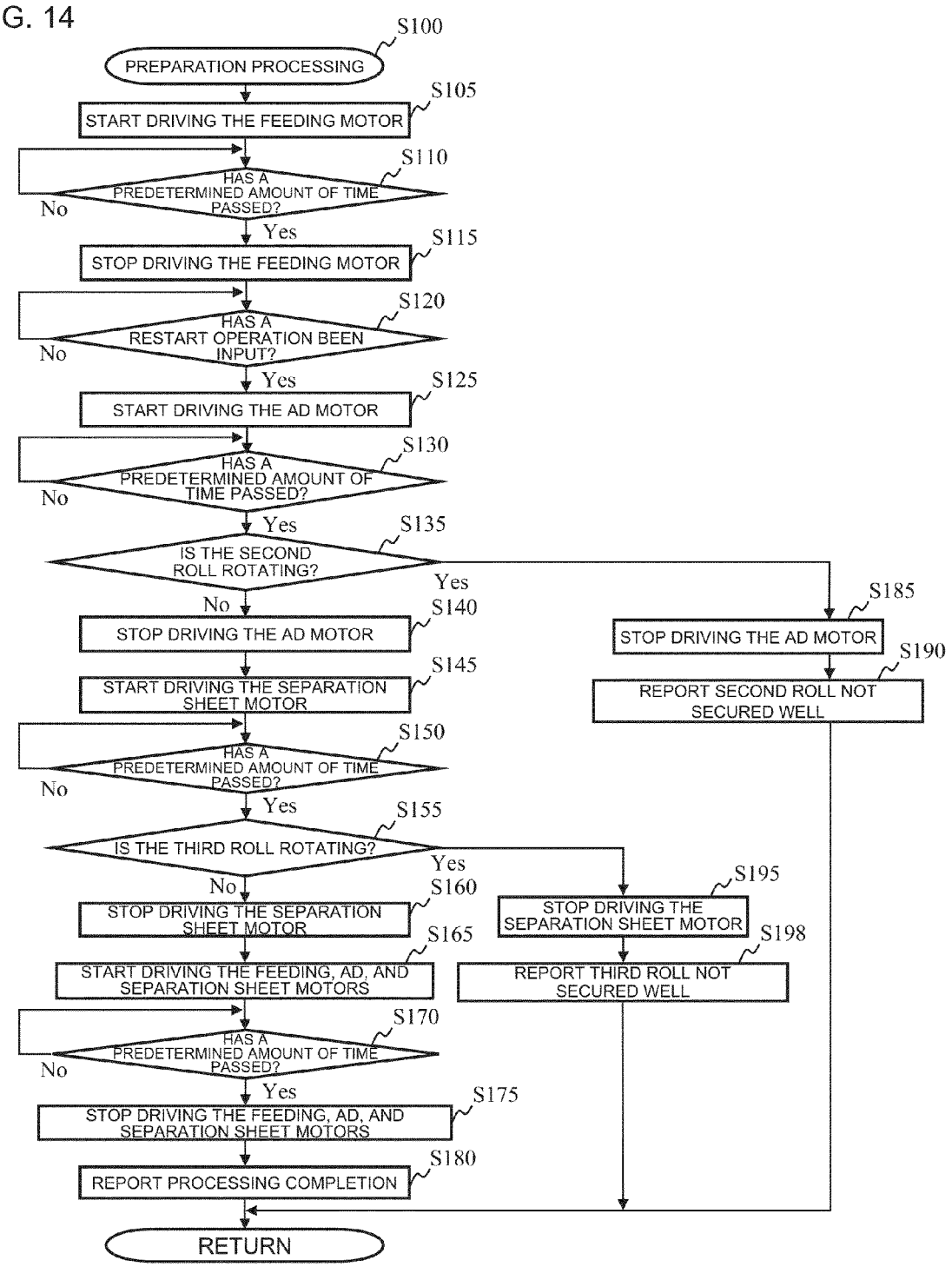
FIG. 14 is a flowchart showing the detailed procedure in step S100.

The following describes the processing content executed by the CPU 212 to achieve the above described technique, using the flow in FIG. 13 and FIG. 14. Note that, in FIG. 13 and FIG. 14, the name of each component is shown suitably abbreviated (hereinafter the same).

In FIG. 13, the flow is started ("START" position) by the user turning ON the power of the tape printer 1, for example.

First, in step S100, the CPU 212 executes the above described preparation processing. FIG. 14 shows the detailed content of this preparation processing.

Details of Preparation Processing

In FIG. 14, first, in step S105, the CPU 212 outputs a control signal to the motor driving circuit 218, and starts the driving of the feeding motor M1.

Subsequently, in step S110, the CPU 212 determines whether or not a predetermined amount of time has passed since the driving of the feeding motor M1 was started in the above described step S105. If the predetermined amount of time has not passed, the condition of step S110 is not satisfied (step S110: NO), and the flow loops back and enters a standby state until the predetermined amount of time passes. In this case, the predetermined amount of time that the flow is in a standby state may be about the amount of time it takes for the above described tape 150-0 positioned on the tip end side of the print-receiving tape 150 fed out from the first roll R1 to be fed from the feeding roller 12 and arrive at the second roll R2 or the third roll R3. If the predetermined amount of time has passed, the condition of step S110 is satisfied (step S110: YES), and the flow proceeds to step S115.

In step S115, the CPU 212 outputs a control signal to the motor driving circuit 218 and stops the driving of the feeding motor M1.

Subsequently, in step S120, the CPU 212 determines whether or not an operation that instructs operation restart has been input by the user via the operation part 216 (or the above described PC 217). If the above described instruction operation has not been input, the condition of step S120 is not satisfied (step S120: NO), and the flow loops back and enters a standby state until the instruction operation is input. If the above described instruction operation has been input, the condition of step S120 is satisfied (step S120: YES), and the flow proceeds to step S125.

In step S125, the CPU 212 outputs a control signal to the motor driving circuit 219, and starts the driving of the adhesive take-up motor M2 (abbreviated as "AD motor" in the figure; refer to the above described FIG. 8B).

Subsequently, in step S130, the CPU 212 determines whether or not a predetermined amount of time has passed since the driving of the adhesive take-up motor M2 was started in the above described step S125. If the predetermined amount of time has not passed, the condition of step S130 is not satisfied (step S130: NO), and the flow loops back and enters a standby state until the predetermined amount of time passes. In this case, the predetermined amount of time that the flow is in a standby state may be about the amount of time it takes for the slack of the above described tapes 150-0, 150-1 from the feeding roller 12 to the second roll R2 to be removed and appropriate tension to be applied (1 s maximum, for example). If the predetermined amount of time has passed, the condition of step S130 is satisfied (step S130: YES), and the flow proceeds to step S135.

In step S135, the CPU 212 determines whether or not the second roll R2 is rotating at this moment based on a detection result of a suitable rotation detection sensor (such as an optical sensor, for example; not shown) disposed in accordance with the second roll R2. If the second roll R2 is not rotating, the condition is not satisfied (S135: NO), and the flow proceeds to step S140.

In step S140, the CPU 212 outputs a control signal to the motor driving circuit 219 and stops the driving of the adhesive take-up motor M2.

Subsequently, in step S145, the CPU 212 outputs a control signal to the motor driving circuit 220, and starts the driving of the separation sheet take-up motor M3 (abbreviated as "separation sheet motor" in the figure; refer to the above described FIG. 8C).

Then, in step S150, the CPU 212 determines whether or not a predetermined amount of time has passed since the start of the driving of the separation sheet take-up motor M3 in the above described step S145. If the predetermined amount of time has not passed, the condition of step S150 is not satisfied (step S150: NO), and the flow loops back and enters a standby state until the predetermined amount of time passes. In this case, the predetermined amount of time that the flow is in a standby state may be about the amount of time it takes for the slack of the separation material layer 151 from the feeding roller 12 to the third roll R3, including the pull-back of the aforementioned separation point, to be removed and appropriate tension to be applied. If the predetermined amount of time has passed, the condition of step S150 is satisfied (step S150: YES), and the flow proceeds to step S155.

In step S155, the CPU 212 determines whether or not the third roll R3 is rotating at this moment based on a detection result of a suitable rotation detection sensor (such as an optical sensor, for example; not shown) disposed in accordance with the third roll R3. If the third roll R3 is not rotating, the condition is not satisfied (S155: NO), and the flow proceeds to step S160.

In step S160, the CPU 212 outputs a control signal to the motor driving circuit 220 and stops the driving of the separation sheet take-up motor M3.

Subsequently, in step S165, the CPU 212 outputs a control signal to the motor driving circuits 218, 219, 220, and starts the driving of the feeding motor M1, the adhesive take-up motor M2, and the separation sheet take-up motor M3.

Then, in step S170, the CPU 212 determines whether or not a predetermined amount of time has passed since the start of the driving of each motor in the above described step S165. If the predetermined amount of time has not passed, the condition of step S170 is not satisfied (step S170: NO), and the flow loops back and enters a standby state until the predetermined amount of time passes. In this case, the predetermined amount of time that the flow is in a standby state may be about the amount of time that it takes to adequately visually verify whether or not the series of operations including the feed-out and feeding of the print-receiving tape 150, the feeding of the tape 150-0, the feeding and take-up of the tape 150-1, the take-up of the separation material layer 151, and the like is normally performed. If the predetermined amount of time has passed, the condition of step S170 is satisfied (step S170: YES), and the flow proceeds to step S175.

In step S175, the CPU 212 outputs a control signal to the motor driving circuits 218, 219, 220, and stops the driving of the feeding motor M1, the adhesive take-up motor M2, and the separation sheet take-up motor M3.

Subsequently, in step S180, the CPU 212 informs the user that all operations have been normally performed and the preparation processing has normally ended by displaying so or the like on the display part 215 (or the PC 217). This flow then terminates here.

On the one hand, if the CPU 212 determines that the second roll R2 had been rotating in the above described step S135, the condition is satisfied (S135: YES), and the flow proceeds to step S185.

In step S185, the CPU 212 outputs a control signal to the motor driving circuit 219 and stops the driving of the adhesive take-up motor M2.

Subsequently, in step S190, the CPU 212 regards the second roll R2 as rotating idly since the tip end of the tape 150-1 is not well secured to the winding core 41 for the second roll R2, and informs the user by displaying so or the like on the display part 215 (or the PC 217). This flow then terminates here.

Further, on the other hand, if the CPU 212 determines that the third roll R3 had been rotating in the above described step S155, the condition is satisfied (S155: YES), and the flow proceeds to step S195.

In step S195, the CPU 212 outputs a control signal to the motor driving circuit 220 and stops the driving of the separation sheet take-up motor M3.

Subsequently, in step S198, the CPU 212 regards the third roll R3 as rotating idly since the tip end of the separation material layer 151 is not well secured to the winding core 29 for the third roll R3, and informs the user by displaying so or the like on the display part 215. This flow then terminates here.

Processing after Preparation Processing Completion

Returning to FIG. 13, once the preparation processing in the above described step S100 has been completed, the flow proceeds to step S202. In step S202, the CPU 212 determines whether or not a production start instruction signal corresponding to a production start operation for the above described second roll R2 performed by the user using the operation part 216 (or the above described PC 217) has been input. If the above described production start instruction signal has not been input, the condition of step S202 is not satisfied (S202: NO), and the flow loops back and enters a standby state. If the above described production start instruction signal has been input, the condition of step S202 is satisfied (S202: YES), and the flow proceeds to step S203.

In step S203, the CPU 212 determines whether or not the total length data indicating the length of the printed matter to be produced (in other words, the total length along the transport direction of the above described tape 150" with print to be generated) has been input in accordance with an operation by the user using the operation part 216 (or the above described PC 217). If the above described total length data corresponding to the length intended by the user has not been input, the condition of step S203 is not satisfied (S203: NO), the flow returns to the above described step S202, and the same procedure is repeated. If the above described total length data has been input, the condition of step S203 is satisfied (S203: YES), and the flow proceeds to step S204.

In step S204, the CPU 212 determines whether or not print data indicating one image desired by the user, to be formed into print on the above described print-receiving tape 150 (repeatedly formed into print in the tape longitudinal direction in this example), has been input in accordance with an operation by the user using the operation part 216 (or the above described PC 217). If the print data has not been input, the condition of step S204 is not satisfied (S204: NO), the flow returns to the above described step S202, and the same procedure is repeated. If the above described print data has been input, the condition of step S204 is satisfied (S204: YES), and the flow proceeds to step S205.

Subsequently, in step S205, the CPU 212 outputs a control signal to the motor driving circuits 218, 219, 220, and starts the driving of the feeding motor M1, the adhesive take-up motor M2, and the separation sheet take-up motor M3. With this arrangement, the feeding of the above described print-receiving tape 150, the tape 150' with print, and the tape 150" with print (hereinafter suitably simply referred to as "tape feeding"), and the take-up of the above described tape 150" with print is started.

Then, the flow proceeds to step S206 where the CPU 212 controls the above described feeding motor M1, adhesive take-up motor M2, separation sheet take-up motor M3, and heating elements of the printing head 11 in coordination. With this arrangement, the feeding roller 12, the take-up mechanism 40, and the printing head 11 work in cooperation, forming the aforementioned test pattern S into print on the print-receiving tape 150 (refer to the above described FIG. 9A).

Subsequently, the flow proceeds to step S207 where the CPU 212 determines whether or not the test pattern S formed into print in the above described step S206 has arrived at a position facing the above described visual confirmation window 300 (in other words, whether or not the feeding distance after the start of feeding in the above described step S205 has arrived at the above described distance L) by the above described tape feeding started in the above described step S205. If the above described test pattern S has not arrived at a position facing the visual confirmation window 300, the condition of step S207 is not satisfied (S207: NO), and the flow loops back and enters a standby state until this condition is satisfied. If the above described test pattern S has arrived at a position facing the visual confirmation window 300, the condition of step S207 is satisfied (S207: YES), and the flow proceeds to step S208.

In step S208, the CPU 212 outputs a control signal to the motor driving circuits 218, 219, 220, and stops the driving of the feeding motor M1, the adhesive take-up motor M2, and the separation sheet take-up motor M3. As a result, tape feeding and the above described take-up of the tape 150" with print are stopped.

Subsequently, the flow proceeds to step S209 where the CPU 212 determines whether or not there was a production continuation instruction for the second roll R2 via a user operation by the above described operation part 216 (or the above described PC 217), based on the test pattern S viewed through the visual confirmation window 300. That is, as shown in the above described FIG. 11A and FIG. 11B, in a case where the white line HL has not been found in the test pattern S, production continuation of the second roll R2 is instructed by the above described user operation as described above, and thus the condition of step S209 is satisfied (S209: YES) and the flow proceeds to step S210. On the other hand, as shown in the above described FIG. 10A and FIG. 10B, in a case where the white line HL has been found in the test pattern S, (the user does not instruct production continuation of the second roll R2 as described above, and thus) the condition of step S209 is not satisfied (S209: NO) and this flow is terminated.

In step S210, the CPU 212 outputs a control signal to the motor driving circuits 218, 219, 220, and starts the driving of the feeding motor M1, the adhesive take-up motor M2, and the separation sheet take-up motor M3, in the same manner as in the above described step S205. As a result, the above described tape feeding and the above described take-up of the tape 150" with print are restarted (refer to FIG. 12A).

Subsequently, in step S215, the CPU 212 determines whether or not the above described tape feeding has arrived where the printing head 11 faces the corresponding print start position by a known technique, based on the print data acquired in the above described step S204. If the feeding has not arrived at the print start position, the condition is not satisfied (S215: NO), and the flow loops back and enters a standby state. If the feeding has arrived at the print start position, the condition of step S215 is satisfied (S215: YES), and the flow proceeds to step S220.

In step S220, the CPU 212 outputs a control signal to the printing head control circuit 221, conducts current to the heating elements of the printing head 11, and starts repeated print formation (repeated formation of the same print part 155) of one image corresponding to the print data input in the above described step S204 in the above described print-receiving tape 150.

Subsequently, in step S230, the CPU 212 determines whether or not the above described tape feeding has arrived where the printing head 11 faces the corresponding print end position by a known technique, based on the print data acquired in the above described step S204. If the feeding has not arrived at the print end position, the condition is not satisfied (S230: NO), the flow returns to the above described step S220, and the same procedure is repeated. If the feeding has arrived at the print end position, the condition is satisfied (S230: YES), and the flow proceeds to step S240.

In step S240, the CPU 212 outputs a control signal to the printing head control circuit 221, and stops conducting current to the heating elements of the printing head 11 and print formation (formation of the print part 155) on the above described print-receiving tape 150. At this time, the tape feeding is continually performed. With this arrangement, the tape 150' with print thereafter becomes blank where the print part 155 does not exist (the aforementioned tape 150-0). Subsequently, the flow proceeds to step S250.

In step S250, the CPU 212 determines whether or not the above described tape feeding has arrived at the cutting position by the above described cutter mechanism 30 (a cutting position such as where the total length along the transport direction of the tape 150" with print wound as the second roll R2 by the take-up mechanism 40 becomes the length intended by the user), in accordance with the total length data acquired in the above described step S203. If the feeding has not arrived at the cutting position, the condition is not satisfied (S250: NO), and the flow loops back and enters a standby state. If the feeding has arrived at the cutting position, the condition is satisfied (S250: YES), and the flow proceeds to step S260.

In step S260, the CPU 212 outputs a control signal to the motor driving circuits 218, 219, 220, and stops the driving of the feeding motor M1, the adhesive take-up motor M2, and the separation sheet take-up motor M3. With this arrangement, the feeding of the above described print-receiving tape 150, the tape 150' with print, and the tape 150" with print (including the above described tape 150-0 as well) is stopped.

Subsequently, in step S265, the CPU 212 outputs a control signal to the motor driving circuit 222, drives the above described cutter motor MC, and cuts the tape 150" with print by the operation of the above described cutter mechanism 30 (refer to FIG. 12B).

Figure 12C:
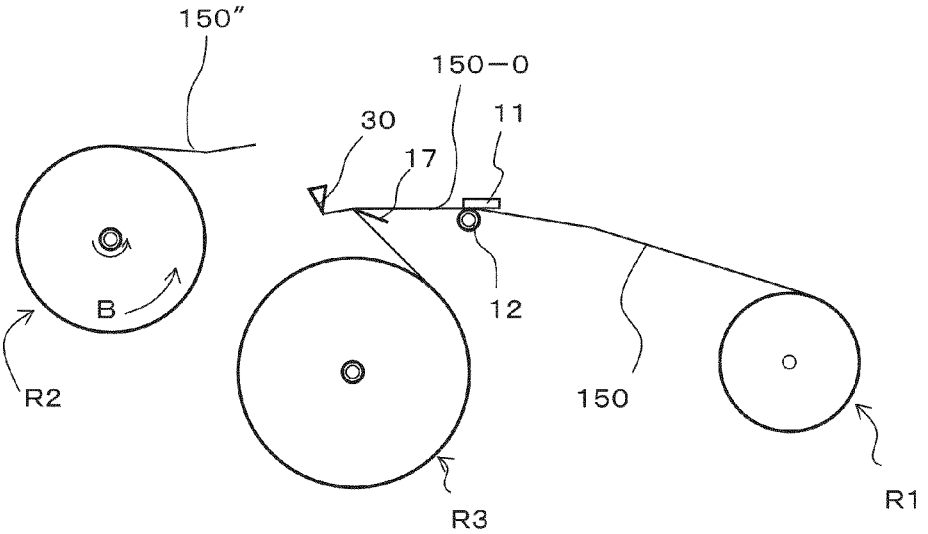
FIG. 12C is an explanatory view showing the tape feeding, cutting, take-up behavior, and the like during printed matter production.

Then, the flow proceeds to step S270, and the CPU 212 outputs a control signal to the motor driving circuit 219, starts the driving of the adhesive take-up motor M2, and starts the take-up of the end edge of the tape 150" with print (refer to FIG. 12C).

Subsequently, in step S275, the CPU 212 determines whether or not a predetermined amount of time has passed since the cutting operation of the cutter mechanism 30 in the above described step S265. If the predetermined amount of time has not passed, the condition is not satisfied (S275: NO), and the flow loops back and enters a standby state. This predetermined amount of time only needs to be a sufficient amount of time for taking up the above described end edge of the tape 150" with print on the above described winding core 41 of the take-up mechanism 40. If the above described predetermined amount of time has passed, this condition is satisfied (S275: YES), and the flow proceeds to step S280.

In step S280, the CPU 212 outputs a control signal to the motor driving circuit 219 and stops the driving of the adhesive take-up motor M2. With this arrangement, the end edge of the tape 150" with print generated by the above described cutting can be reliably taken up.

Once the above described step S280 ends, this flow is terminated.

As described above, in this embodiment, before the start of production of the second roll R2 and after preparation processing, the desired test pattern S is formed into print and tape feeding is controlled so that the formed test pattern S arrives and stops near the visual confirmation window 300. With this arrangement, the user can visually confirm the test pattern S formed on the adhesive tape 150" with print via the visual confirmation window 300. Accordingly, the user can visually confirm whether or not the print quality of the test pattern S has decreased due to the occurrence of the white line HL such as described above or the like from the visual confirmation window 300 before production of the second roll R2 is actually started. As a result, it is possible to suppress the wasteful occurrence of defective products such as described above, making it possible to improve convenience.

Further, in particular, according to this embodiment, the above described test pattern S that includes the thick line S1 and the thin line S2, each extending in the width direction of the print-receiving tape 150, is formed into print. This design has significance such as follows. That is, as described above, in a case where dust or the like sticks to the printing head 11 and nearby area, for example, the white line HL occurs linearly along the tape longitudinal direction (in other words, the transport direction; refer to the above described FIG. 7 and FIG. 10). Accordingly, in a case where the test pattern S made of a line in the tape width direction is to be printed, a non-print linear region in which the test pattern S is orthogonal to and crosses the tape longitudinal direction is formed if the above described sticking exists (refer to FIG. 10A and FIG. 10B). However, if the above described test pattern S is a thin line, for example, the surface area of the linear break resulting from the non-print linear region that occurs as described above is small and unnoticeable (refer to the line S1 in FIG. 10B). Conversely, if the above described test pattern S is a relatively thick line, the surface area of the above described break resulting from the above described non-print linear region is large (larger than in the case of the above described thin line) and noticeable (refer to the line S2 in FIG. 10B). Nevertheless, in this case, since the energy imparted from the heating elements for forming the thick line is relatively large, the above described energy is transmitted from both sides with respect to the region where a non-print section should be, possibly causing the non-print section to disappear.

Hence, according to this embodiment, the above described test pattern S comprising both the thick line S1 and the thin line S2 in the tape width direction is formed into print. With this arrangement, it is possible for the user to avoid adverse effects such as described above and reliably visually confirm the thin linear white line HL resulting from the sticking of dust or the like.

Note that various modifications may be further made without deviating from the spirit and scope of the present disclosure. The following describes such modifications.

(1) In a Case where the Test Pattern Extends Diagonally

Figure 15:
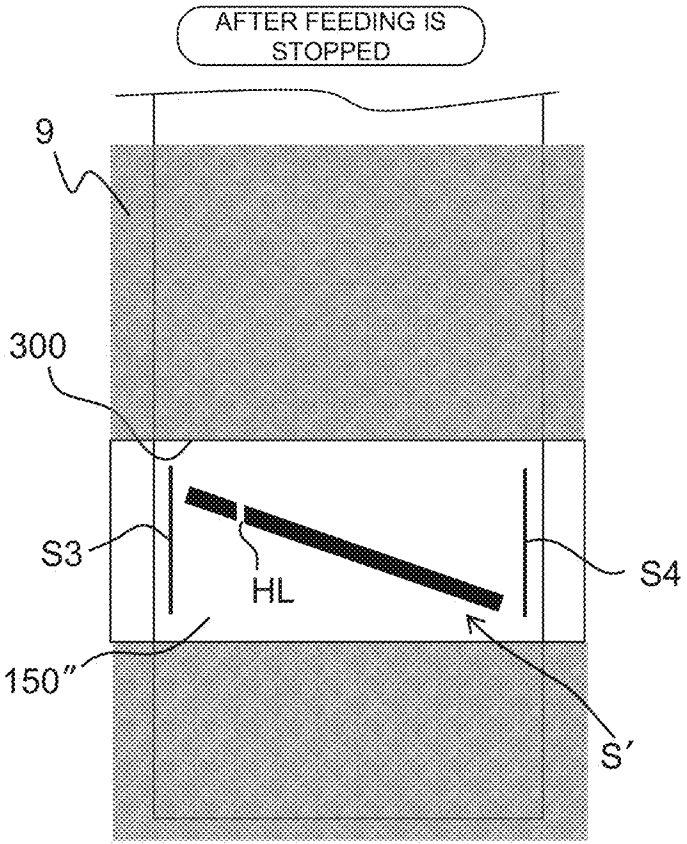
FIG. 15 is a view showing a modification in which a linear test pattern that extends diagonally is formed into print.

According to this modification, as shown in FIG. 15, a linear test pattern S' that extends diagonally at a predetermined angle with respect to the width direction and longitudinal direction of the print-receiving tape 150 is formed into print.

Such the test pattern S' has the following significance. That is, in a case where a line in the tape width direction is formed into print as the test pattern S while the print-receiving tape 150 is fed (refer to the above described FIG. 10 and FIG. 11), the timing at which energy is applied from the heating elements is substantially simultaneous across the entire width of the print-receiving tape 150. As a result, as described above, depending on the amount of the energy applied at that timing, the above described energy may be transmitted from both sides with respect to the region where the white line HL (non-print section) should be, causing the white line HL to disappear.

Hence, according to this modification, the test pattern S' that extends diagonally with respect to the tape width direction and longitudinal direction is formed into print as shown in FIG. 15. In this case, the timing at which energy is applied from the heating elements is not substantially simultaneous as described above, but rather the energy is applied at a timing shifted little by little according to the width direction position of the print-receiving tape 150. As a result, it is possible to suppress the disappearance of the non-print section resulting from transmission of the aforementioned energy, and allow the user to reliably visually confirm the white line HL.

Note that the line itself does not need to extend diagonally as in the above described test pattern S'. That is, as shown in FIG. 16, the line pattern (a first pattern S13 and a second pattern S14 in this example) itself that constitutes a test pattern S" may extend in the transport direction as long as the test pattern S" extends diagonally at large.

Figure 16:
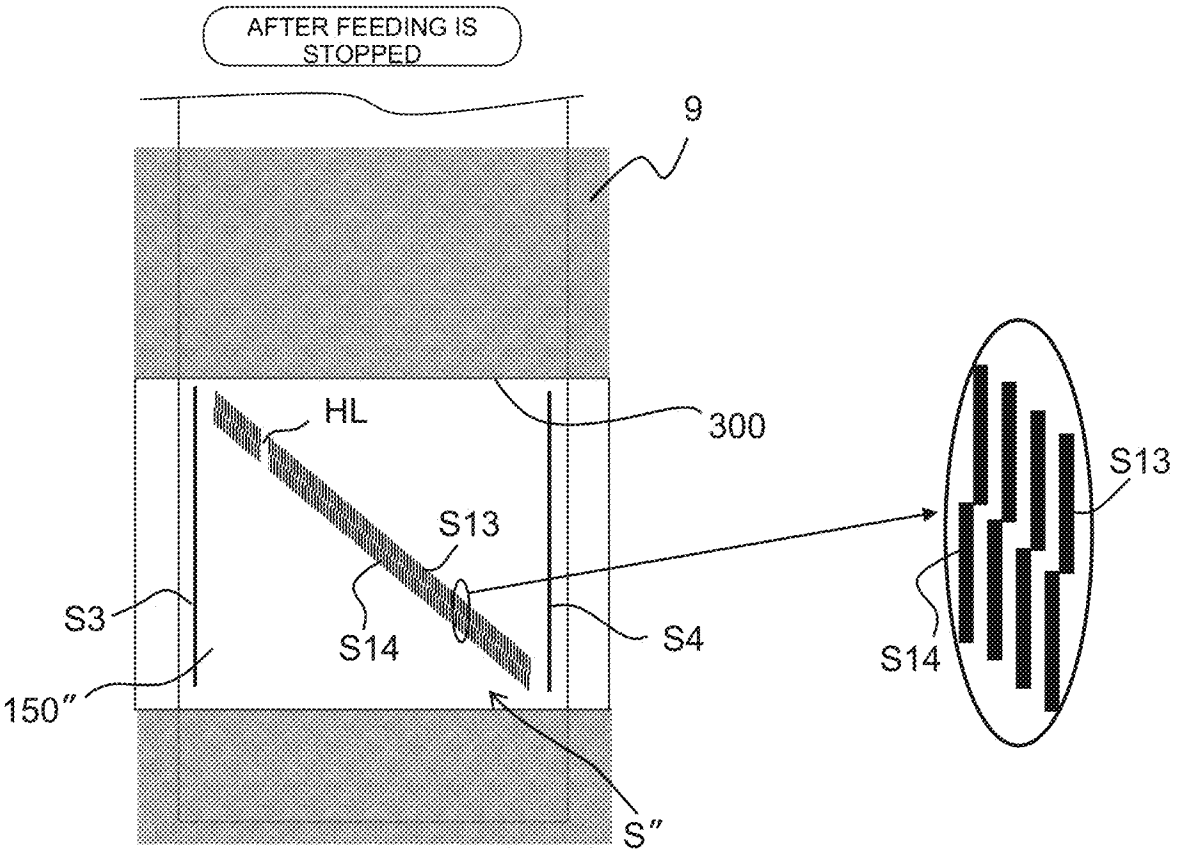
FIG. 16 is an explanatory view showing a modification in which a test pattern that extends diagonally at large is formed into print by staggering two patterns.

That is, as shown in FIG. 16, in this example, a great number of the above described first patterns S13 that comprise a predetermined transport direction dimension and a predetermined width direction dimension and extend in the transport direction (in other words, the longitudinal dimension; hereinafter the same) is disposed. At this time, the two adjacent first patterns S13, S13 are disposed at a predetermined pitch (substantially the same pitch as the above described width direction dimension in this example), and the transport direction position of each is shifted (in accordance with the above described diagonally extended direction). Furthermore, a great number of the above described second patterns S14 that comprise the same above described predetermined transport direction dimension and the above described predetermined width direction dimension as the above described first pattern S13, and extend in the transport direction is disposed. Two adjacent second patterns S14, S14 are also disposed at a predetermined pitch (substantially the same pitch as the above described width direction dimension in this example), and the transport direction position of each is shifted (in accordance with the above described diagonally extended direction). Then, the above described first pattern S13 and second pattern S14 are alternately staggered so that the position of one second pattern S14 in the tape width direction is in a tape width direction position in the blank area between the two adjacent above described first patterns S13, S13 (and similarly the position of one first pattern S14 in the tape width direction is in a tape width direction position in the blank area between the two adjacent above described second patterns S14, S14).

In the configuration in FIG. 16, there is always a blank area where printing is not performed on both outer sides of one first pattern S13 and one above described second pattern S14 in the tape width direction. As a result, the energy resulting from the heat from the heating elements is distributed, and fill-in between the first pattern S13 and the second pattern S14 does not occur. That is, if there is a solid black region without such a blank area as described above, print blurring may occur and, in that case, the user may have difficulty visually confirming the above described white line HL. Conversely, according to the configuration in FIG. 16, such print blurring does not occur. Further, one second pattern S14 always exists in the tape width direction position corresponding to the blank area between the two adjacent first patterns S13, S13, and one first pattern S13 always exists in the tape width direction position corresponding to the blank area between the two adjacent second patterns S14, S14. That is, all heating elements that execute print formation on the print-receiving tape 150 among the heating elements of the printing head 11 form either the entire first pattern S13 or the entire second pattern S14, and are therefore always energized (turned ON) once. As a result, if faint print occurs due to dust or the like stuck to the above described printing head 11, the faint print reliably appears as the white line HL without exception (the white line HL always occurs in either the first pattern S13 or the second pattern S14). As a result, the user can reliably recognize the location of occurrence of the white line HL. In particular, the user can easily determine whether or not the above described faint print exists since the pattern is a simple geometrical pattern made of the first pattern 13 and the second pattern 14. Note that, from the point of ensuring the above described reliable recognition by the user, the first pattern S13 and the second pattern S14 preferably comprise a measurable width direction dimension (at least 4 dots, for example) and longitudinal direction dimension (30 dots, for example).

Figure 17A:
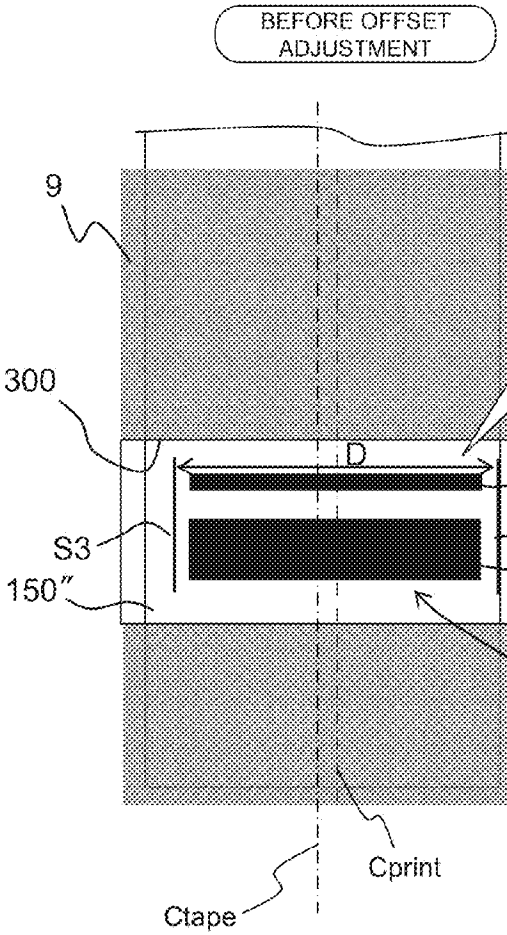
FIG. 17A is an explanatory view showing a modification in which offset adjustment is performed in a case where the print formation center of the test pattern is shifted.
Figure 17B:
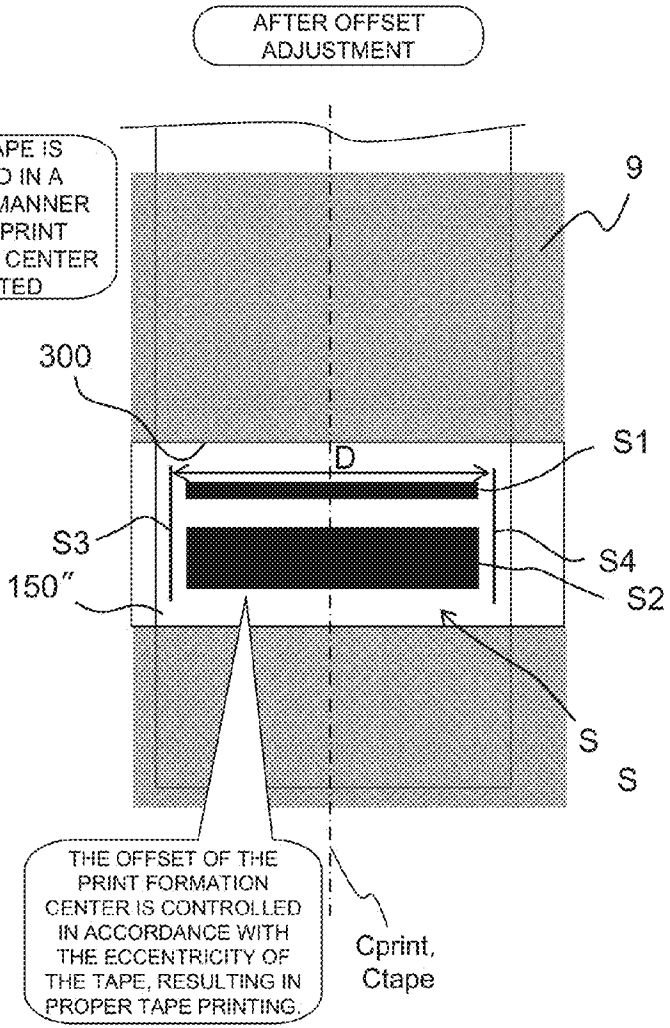
FIG. 17B is an explanatory view showing a modification in which offset adjustment is performed in a case where the print formation center of the test pattern is shifted.

(2) Offset Adjustment in a Case where the Print Formation Center is Shifted with Respect to the Tape Center The test pattern formed into print as described above can be used to adjust the offset of the print formation region resulting from the printing head 11. FIG. 17A and FIG. 17B show such a modification.

For example, the test pattern S (comprising end lines S3, S4 in addition to the lines S1, S2 as described above) formed as described above may deviate in the tape width direction as shown in FIG. 17A due to play or the like during the above described mounting of the tape cartridge TK. That is, in this example, a tape width direction center line Cprint of the printing head 11 is shifted to the right side in the figure with respect to a tape width direction center Ctape of the tape 150" with print due to the above described play or the like. Note that, as described above, the width D between the above described end lines S3, S4 is substantially the same as the tape width direction dimension (more accurately, the tape width direction dimension of the region heated by the heating elements) of the printing head 11. Accordingly, the user can easily visually confirm whether or not there is a shift and the extent thereof between the tape width direction center line Ctape of the above described printing head 11 and the tape width direction center line Cprint of the above described tape 150" with print by whether or not the above described end lines S3, S4 have been formed evenly in the tape width direction with respect to the tape 150" with print, from the visual confirmation window 300. That is, the user can confirm a tape setting shift (the tape 150" with print shifted to the left side in the figure in the example in FIG. 17A) from the visual confirmation window 300 using the test pattern S.

According to this modification, in such a case, the user executes print formation of the test pattern S once again while suitably operating the above described operation part 216 or the above described PC 217, in accordance with the visual confirmation result from the above described visual confirmation window 300, making it possible to adjust the offset of the print formation center by the printing head 11 (in accordance with the above described eccentricity of the tape to the left side). That is, while a detailed description is omitted, the CPU 212 controls the heating region made of the plurality of heating elements in accordance with the above described operation amount by the user, making it possible to match the above described center line Cprint with the above described center line Ctape and make the tape into a proper print mode. At this time, if a scale (not shown) is disposed on the above described visual confirmation window 300, for example, it is furthermore possible to easily adjust the offset.

(3) In a Case where a Print Start Mark is Formed

That is, according to this modification, when the above described printed matter is produced by take-up of the tape 150" with print as described above, a print start mark is formed in addition to the above described test pattern S.

That is, according to this modification, after a tip end region P1 (a region connected to the winding core 41 on the tip end side of a print area P2 described later) of the tape 150-1 is attached to the above described winding core 41 by the user (refer to FIG. 18A and FIG. 18B) and the aforementioned preparation processing is performed, print formation of the above described test pattern S and take-up of the tape 150" with print are started.

At this time, when print is formed in the print area P2 (the region where desired print is formed) with the printing head 11 not yet sufficiently warmed up, the above described faint print may occur in a section of the print contents (the characters "UENO-TECH" repeatedly printed in this example). Hence, in this modification, a print start mark HR for clearly indicating the start position of the print area P2 (in other words, for clearly distinguishing the tip end region P1 and the print area P2) is formed in the border area between the above described print area P2 and the above described tip end region P1 of the tape 150-0 (refer to FIG. 18C). That is, the print start mark HR is formed further on the transport direction upstream side than the test pattern S. With this arrangement, the printing head 11 forms the print start mark HR in the above described border area prior to formation of desired print in the print area P2 as described above, making it possible to execute print formation in the above described print area P2 in a sufficiently warmed up state due to the formation operation, and perform favorable printing without faint print (refer to FIG. 18D).

Practical Use of the Tip End Region

Figure 19A:
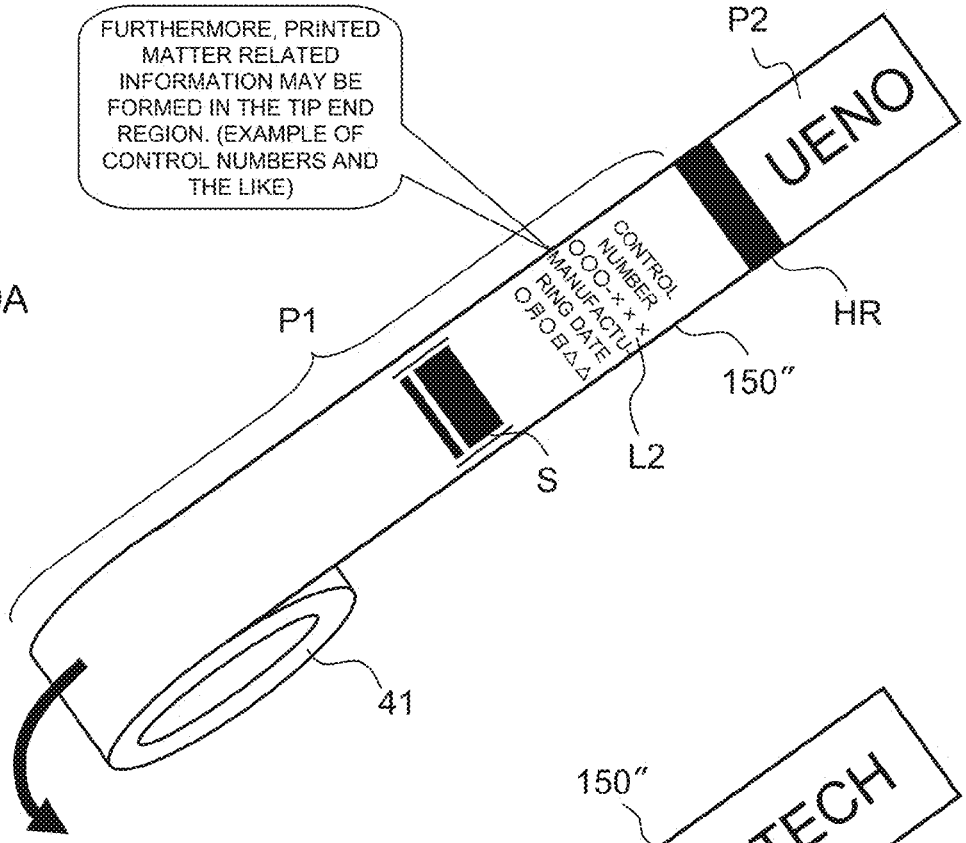
FIG. 19A is an explanatory view showing printed matter related information formed in the tip end region.
Figure 19B:
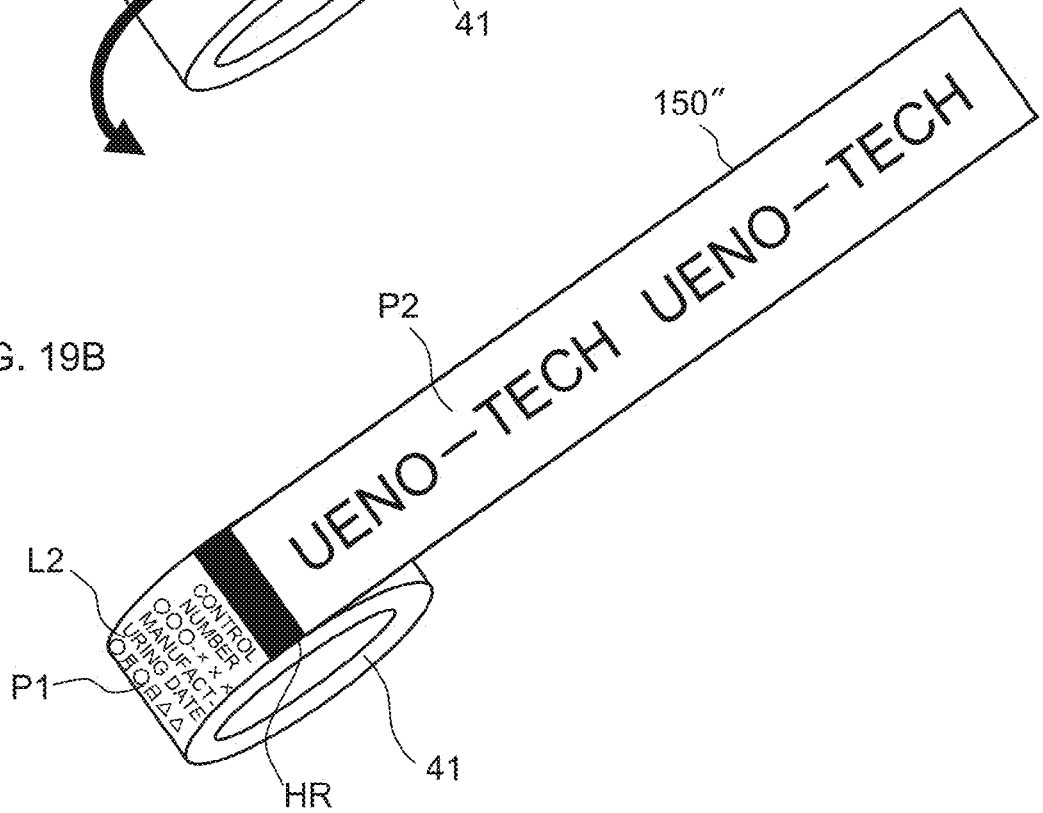
FIG. 19B is an explanatory view showing printed matter related information formed in the tip end region.

Further, in addition to the above, as shown in FIG. 19A and FIG. 19B, notation characters L2, such as a control number (so-called serial number or the like), manufacturing date, or the like, may be printed in the tip end region P1 as printed matter related information in relation to the above described printed matter to be generated. In this example, the above described notation characters L2 are formed further on the transport direction upstream side than the test pattern S, and the above described print start mark HR is formed further on the transport direction upstream side than the above described notation characters L2. With this arrangement, the above described tip end region P1 separated from the print area P2 via the above described print start mark HR can be effectively utilized as a suitable information display area.

Note that while the example in FIG. 18 and FIG. 19 shows a case where the test pattern S of the mode shown in FIG. 10 and FIG. 11 is formed, the present disclosure is not limited thereto, allowing formation of the test pattern S of the mode shown in FIG. 15 and FIG. 16, for example. Further, while the example in FIG. 18 and FIG. 19 shows a case where the print start mark HR (a blackened region across the entire tape width) is formed, the present disclosure is not limited thereto. That is, the print start mark HR of a mode similar to the test pattern S" shown in FIG. 16, that is, of a mode wherein pattern equivalents to the first pattern S13 and the second pattern S14 are alternately staggered, may be formed.

(4) Other

Note that, in the above, the arrows shown in FIG. 6 denote an example of signal flow, but the signal flow direction is not limited thereto.

Also note that the present disclosure is not limited to the procedures shown in the above described flows of the flowcharts in FIG. 13 and FIG. 14, and procedure additions and deletions as well as sequence changes and the like may be made without deviating from the spirit and scope of the disclosure.

Further, other than that already stated above, techniques based on the above described embodiments and each of the modifications may be suitably utilized in combination as well.

What is claimed is:

1. A printer comprising:

a feeder configured to feed a recording medium;

a feeding motor configured to drive said feeder;

a printing head configured to form desired print by heating elements on said recording medium fed by said feeder and form a recording medium with print;

a take-up body configured to sequentially take up said recording medium with print on an outer circumference and produce a roll-shaped printed matter;

a take-up motor configured to drive said take-up body;

a housing comprising said feeder, said feeding motor, said printing head, said take-up body, and said take-up motor in its interior;

a visual confirmation window that is provided on said housing and is for visually confirming said recording medium with print taken up by said take-up body disposed in an interior of said housing from an exterior of said housing;

a first coordination control portion configured to control said feeding motor, said take-up motor, and said heating elements in coordination so as to form a predetermined test pattern on said recording medium prior to starting production of said printed matter; and a second coordination control portion configured to control said feeding motor and said take-up motor in coordination so that, after formation of said test pattern on said recording medium by the control of said first coordination control portion, said test pattern formed on said recording medium arrives and stops near said visual confirmation window.

2. The printer according to claim 1, further comprising:

a third coordination control portion configured to control said feeding motor and said take-up motor in coordination so as to remove slack of said recording medium at the time of preparation operation prior to starting production of said printed matter, wherein said first coordination control portion is configured to control said feeding motor, said take-up motor, and said heating elements in coordination so as to form a predetermined test pattern on said recording medium after removal of slack of said recording medium by the control of said third coordination control portion and before starting production of said printed matter.

3. The printer according to claim 1, wherein:

said first coordination control portion is configured to control said feeding motor, said take-up motor, and said heating elements in coordination so as to form said test pattern that includes a first line comprising a thick width that extends along a width direction of said recording medium, and a second line comprising a thin width that extends along said width direction of said recording medium.

4. The printer according to claim 1, wherein:

said first coordination control portion is configured to control said feeding motor, said take-up motor, and said heating elements in coordination so as to form said test pattern that extends diagonally at a predetermined angle with respect to a width direction and a longitudinal direction of said recording medium.

5. The printer according to claim 1, wherein:

said first coordination control portion is configured to control said feeding motor, said take-up motor, and said heating elements in coordination so as to form said test pattern that comprises a plurality of first patterns that extend along a longitudinal direction of said recording medium, each disposed at a predetermined pitch in a width direction of said recording medium, and a plurality of second patterns that extend along a longitudinal direction of said recording medium, each disposed at said predetermined pitch in the width direction of said recording medium, wherein said first pattern and said second pattern are alternately arranged in a staggered manner so that a position of one second pattern in said width direction matches the position of a blank area in said width direction, the blank area being between two adjacent said first patterns.

6. The printer according to claim 1, wherein:

said printing head forms desired print in a predetermined print area of said recording medium fed by said feeder;

said take-up body sequentially takes up said recording medium on an outer circumference part with a tip end region of said recording medium positioned on downstream side in a transport direction than said print area connected and produces said printed matter; and said first coordination control portion is configured to control said feeding motor, said take-up motor, and said heating elements in coordination so as to form said test pattern in said tip end region.

7. The printer according to claim 6, wherein:

said first coordination control portion is configured to control said feeding motor, said take-up motor, and said heating elements in coordination so as to form printed matter related information in relation to said printed matter in said tip end region.

8. The printer according to claim 7, wherein:

said first coordination control portion is configured to control said feeding motor, said take-up motor, and said heating elements in coordination so as to form said printed matter related information on upstream side in a transport direction than said test pattern in said tip end region.

9. The printer according to claim 7, wherein:

said first coordination control portion is configured to control said feeding motor, said take-up motor, and said heating elements in coordination so as to form a print start mark that indicates a start of said print area at a position of said recording medium, the position serving as a border between said tip end region and said print area.

10. The printer according to claim 9, wherein:

said first coordination control portion is configured to control said feeding motor, said take-up motor, and said heating elements in coordination so as to form said printed matter related information on upstream side in a transport direction than said test pattern in said tip end region.

11. The printer according to claim 9, wherein:

said first coordination control portion is configured to control said feeding motor, said take-up motor, and said heating elements in coordination so as to form said print start mark that comprises a plurality of third patterns that extend along a longitudinal direction of said recording medium, each disposed at a predetermined pitch in a width direction of said recording medium, and a plurality of fourth patterns that extend along a longitudinal direction of said recording medium, each disposed at said predetermined pitch in the width direction of said recording medium, wherein said third pattern and said fourth pattern are alternately arranged in a staggered manner so that a position of one fourth pattern in said width direction matches the position of a blank area in said width direction, the blank area being between two adjacent said third patterns.

* * * * *